US007901018B2

(12) United States Patent
Baughman

(10) Patent No.: US 7,901,018 B2
(45) Date of Patent: Mar. 8, 2011

(54) PORTABLE WORKSTATION

(76) Inventor: Joe D. Baughman, Leeds, UT (US)

( * ) Notice: Subject to any disclaimer, the term of this patent is extended or adjusted under 35 U.S.C. 154(b) by 848 days.

(21) Appl. No.: 11/248,825

(22) Filed: Oct. 12, 2005

(65) Prior Publication Data

US 2006/0076861 A1 Apr. 13, 2006

Related U.S. Application Data

(60) Provisional application No. 60/618,428, filed on Oct. 13, 2004.

(51) Int. Cl.
*A47B 85/00* (2006.01)

(52) U.S. Cl. ..... 312/240; 312/313; 312/317.3; 190/11; 190/117

(58) Field of Classification Search ..... 312/280, 312/281, 282, 313, 314, 317.1, 317.3, 237, 312/240, 241; 126/38; 190/11, 12 A, 12 R, 190/39, 115, 117; 280/30; 108/99, 101; 16/113.1

See application file for complete search history.

(56) References Cited

U.S. PATENT DOCUMENTS

| | | | | | |
|---|---|---|---|---|---|
| 363,372 | A | * | 5/1887 | Dollens | 312/291 |
| 1,326,809 | A | * | 12/1919 | Twiss | 190/12 R |
| 1,478,371 | A | | 12/1923 | Albrighton | |
| 2,206,004 | A | * | 6/1940 | Ford | 108/69 |
| 2,351,610 | A | * | 6/1944 | Hamberg | 312/310 |
| 2,497,156 | A | * | 2/1950 | Davis | 190/12 R |
| 3,866,994 | A | * | 2/1975 | Bonin | 312/236 |
| 3,915,529 | A | | 10/1975 | Bernier | 312/237 |
| 4,436,353 | A | * | 3/1984 | Tucker | 312/241 |
| 4,919,109 | A | | 4/1990 | Riley | 126/9 |
| 4,934,280 | A | | 6/1990 | Bae | 108/99 |
| 5,249,438 | A | * | 10/1993 | Rhaney et al. | 62/457.7 |
| 5,518,258 | A | | 5/1996 | Cox | |
| 5,706,921 | A | * | 1/1998 | Wang | 190/115 |
| 5,913,270 | A | | 6/1999 | Price | 108/101 |
| 5,941,352 | A | | 8/1999 | Lee | 190/11 |
| 6,053,587 | A | | 4/2000 | Boerder | |
| 6,079,400 | A | | 6/2000 | Tomat Dany | 126/37 |
| 6,439,134 | B1 | * | 8/2002 | Ryburg | 108/42 |
| 6,450,161 | B1 | | 9/2002 | Izumi | 126/9 |
| 6,464,098 | B1 | | 10/2002 | Henson et al. | 220/475 |
| 6,464,245 | B1 | * | 10/2002 | Miles | 280/655.1 |
| 6,471,019 | B1 | | 10/2002 | Miller | |
| 6,543,436 | B2 | | 4/2003 | Montgomery | 126/38 |
| 6,543,796 | B1 | | 4/2003 | Johnson et al. | |
| 6,644,447 | B2 | | 11/2003 | Pohl | |
| 7,278,644 | B2 | * | 10/2007 | Villarreal | 280/47.26 |
| 2003/0132079 | A1 | * | 7/2003 | Bellini | 190/115 |

* cited by examiner

*Primary Examiner* — James O. Hansen
(74) *Attorney, Agent, or Firm* — Kunzler Needham Massey & Thorpe

(57) ABSTRACT

A portable workstation, in one embodiment, includes a base unit and a table. The base unit includes one or more vertical support members and a platform extending horizontally from the vertical support member. The platform forms the top of the base unit in an upright position. The table is configured to extend from the top of the base unit and includes a support leg. The table transitions between an extended position and a storage position. When the table is in the extended position, the table provides support to the base unit of the workstation, forming an integrated tripod system. Thus, the base unit may be compact and easily transported in a storage position; however, the platform and the table when extended may provide an ample work surface at a traditional working height. The base unit may include a frame structure and may be transported on wheels or carried like a back pack in certain embodiments.

18 Claims, 14 Drawing Sheets

PORTABLE WORKSTATION

CROSS-REFERENCES TO RELATED APPLICATIONS

This application is a continuation-in-part of and claims priority to U.S. Provisional Patent Application No. 60/618,428 entitled "KITCHEN PACK" and filed on Oct. 13, 2004 for Joe Baughman, which is incorporated herein by reference.

BACKGROUND OF THE INVENTION

1. Field of the Invention

This invention relates to portable work surfaces and more particularly relates to portable workstations that are lightweight and compact.

2. Description of the Related Art

Preparing food in a primitive environment can be a challenge for those people who normally prepare food in an organized kitchen. In an undeveloped area such as a campsite or lakeside, the user generally lacks a sturdy structure to organize kitchen items and to provide a sufficient working surface for preparing food and eating. Without a proper work surface, food can easily become soiled or contaminated and kitchen items can easily become excessively disorganized and unmanageable. In addition, packing utensils and cookware can also become a challenge, as many boxes or containers are typically required to pack a sufficient amount of cookware, cooking supplies, seasonings, pans, etc. Furthermore, the user may fail to pack all of the necessary provisions because of the difficult task of disemboweling a kitchen and then remembering what is needed and what has already been packed.

To facilitate the packing process, as well as to provide a temporary preparation area, several versions of a "camp kitchen" have been introduced into the market. The camp kitchens known in the art typically include a folding storage cabinet and commodities typically found in a kitchen environment, such as tables, drawers, stoves, storage compartments, sinks and the like. These camp kitchen, however, are generally heavy, bulky, and difficult to transport because they are often made of wood, steel, or other heavy materials to provide economy for this type of construction and to hold drawers, organizers, and the contents while traveling.

A common style of camp kitchen is a box style, which requires multiple rigid surfaces (top, bottom, sides) to maintain the container shape. The rigid surfaces of the container can only function in a limited way to provide work surfaces and other peripheral devices, such as tables, shelves, windscreens, etc. For example, the front of the box may function as a table, but since the rigid surface must hold the box together in a storage position, the rigid surface cannot fold or collapse for greater portability or to decrease the overall bulk. Thus, the size of the table is generally limited to the size of the box, which typically signifies providing a larger, bulkier box for sufficient work space. In a further example, the top or sides of the box may function as a windscreen; however, the rigid surfaces generally do not provide the lightest, most economical or most portable method of creating a windscreen.

Furthermore, items stored in a box style camp kitchen are typically difficult to access during transportation. Usually, the user must open the entire box to access the drawers and/or contents inside the box. In addition, the camp kitchens are often transported in a different orientation than the selected set up orientation, which may hinder user access during transport.

Typically, the camp kitchens require an additional stand that must be transported along with the camp kitchen in order to maintain the kitchen table(s) and/or surfaces at a useful working height. Because the camp kitchens must be stabilized from front to back, the camp kitchens and the stands are inherently large and bulky, even though the stands may fold, scissor, etc. Bulky stands and bulky camp kitchens are usually difficult to transport and typically still provide limited work space.

From the foregoing discussion, it should be apparent that a need exists for an apparatus that provides an ample working surface and is compact, lightweight and easily transportable. Beneficially, such an apparatus, system, and method would further enable the user to pack and organize items in an accessible storage compartment. The apparatus would further provide the working surface at an appropriate height for the user without requiring an additional stand.

SUMMARY OF THE INVENTION

The present invention has been developed in response to the present state of the art, and in particular, in response to the problems and needs in the art that have not yet been fully solved by currently available portable workstations, particularly portable camp kitchens. Accordingly, the present invention has been developed to provide a lightweight, compact, portable workstation that overcomes many or all of the above-discussed shortcomings in the art.

The portable workstation, in one embodiment, includes a base unit and a table. The base unit includes one or more vertical support members and a platform extending horizontally from the vertical support member. The platform forms the top of the base unit in an upright position. The table is configured to extend from the top of the base unit and includes a support leg. The table transitions between an extended position and a storage position. When the table is in the extended position, the table provides support to the base unit of the workstation, forming an integrated tripod system. Thus, the base unit may be compact and easily transported in a storage position; however, the platform and the table when extended may provide an ample work surface at a traditional working height. The base unit may include a frame structure and may be transported on wheels or carried like a back pack in certain embodiments.

The workstation, in one embodiment, provides an additional vertical support that extends from the top of the base unit and enables the user to attach accessories, such as a rack system of shelves, a rotating spice rack, attachable storage receptacles, a soft cabinet, lighting, water, etc., for additional convenience. In one embodiment, the additional vertical support comprises a handle integrated into the base unit and configured to telescopically extend from the top of the base unit. In a retracted position, the handle facilitates maneuvering and transporting the workstation.

The workstation may further comprise one or more side tables configured to extend from the top of the base unit. The side tables may alternate between an extended position and a storage position. In certain embodiments, the side table(s) and platform are removable. In one embodiment, the side tables are hingedly connected to the workstation. In addition, the side tables may include multiple slats, which may be hingedly connected together in certain embodiments. In certain embodiments, the side table may include a collapsible sink.

In certain embodiments, the workstation includes one or more storage compartments disposed along the vertical support member. The storage compartment may comprise a shelf and/or a drawer or the like. In one embodiment, the storage compartment includes an enclosed soft cabinet that extends between multiple vertical support members. In an alternative embodiment, the base unit includes a wall to shelter the storage compartment. The wall may be rigid and may be made of molded plastic or aluminum in certain embodiments. Alternatively, the wall may be made of a flexible material such as nylon material or polyester. The selected material may contribute to the overall weight and portability of the workstation.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

In one embodiment, the portable workstation is structurally designed for storing and transporting kitchen items and for providing an ample work surface. In alternative embodiments, the portable workstation may provide storage and an ample work surface for other uses, such as field research, a computer workstation, or a project workstation for hobbies, tools, or the like. The portable workstation of the present invention both hauls the kitchen goods or other items and subsequently sets up into a full kitchen or work station with tables, yet the workstation remains very lightweight and portable.

The platform may be disposed at a usable height, precluding the need for additional stands or racks. The collapsible tables may provide additional work space, and the rack system may provide further support for hanging items and suspending shelves. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1A:
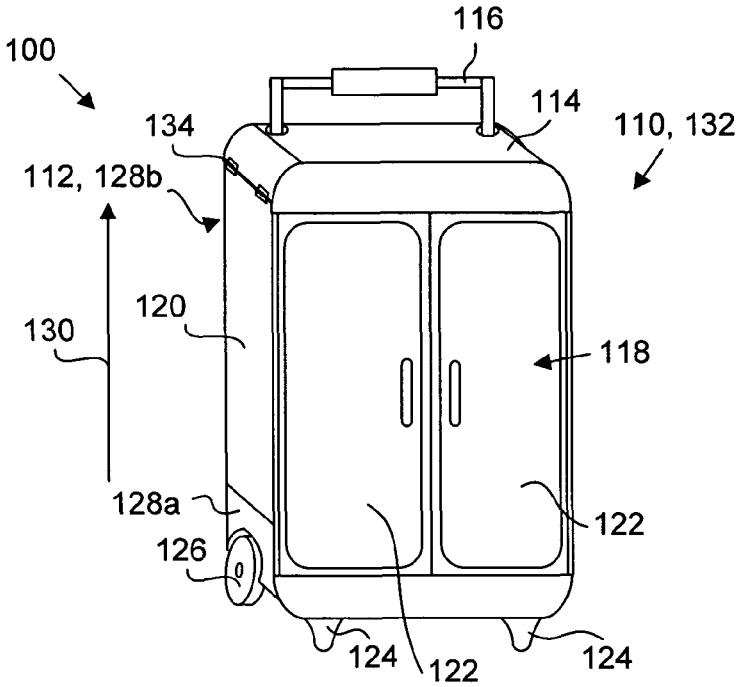
FIG. 1A is a perspective view illustrating one embodiment of a portable workstation in accordance with the present invention.

FIG. 1A depicts one embodiment of a portable workstation 100 in accordance with the present invention. The portable workstation 100, as depicted, includes a base unit 110, a vertical support member 112, a platform 114, a handle 116, a storage compartment 118, a side table 120, cabinet doors 122, front supports 124, wheels 126, and a rigid wall 128. The portable workstation 100 may include wheels 126 and the handle 116 to facilitate transporting the portable workstation 100 and may function similar to wheeled luggage. The wheels 126 may be attached to the base unit 110 to mobilize the workstation 100 for easy transportation of stored items.

The base unit 110, in the depicted embodiment, may remain in a substantially upright position 130 while stationary and during transport. The front supports 124 may provide support to the base unit 110 in a storage position 132 as depicted. In the depicted embodiment, many of the structural components may be made of molded plastic, such as the vertical support member 112 and wall 128, which enables the workstation 100 to be durable, lightweight and easily transportable. Alternatively, the components may be made other rigid materials, such as aluminum and the like. In one embodiment, the workstation 100 comprises a mix of rigid and flexible materials, such as plastic and fabric. In certain embodiments, the workstation 100 includes a frame structure (not shown) for support.

The upright position 130, or vertical storage position 132, enables the user to store items such as kitchen items in the storage compartment 118 in substantially the same orientation as the items are accessed for use. Consequently, the user may easily access the stored items during transport, if desired. In one embodiment, the cabinet doors 122 rotate open and closed, as is known in the art, to enclose a cupboard or the like. The storage compartment 118 will be discussed in greater detail with relation to FIG. 1C.

The vertical support 112, in certain embodiments, may be a frame structure, rigid panel, or the like to support the platform 114 in the upright position 130. The platform 114, which may be removable in certain embodiments, forms the top to the base unit 110 in the storage position 132. In the depicted embodiment, the rigid walls 128 function as the vertical support members 112 to support the platform 114. The walls 128, which give shape and structure to the workstation 100, may further shelter the storage compartment 118 and facilitate storage and transportation of items.

One or more side tables 120 may be disposed along the outer walls 128*a* of the base unit 110 for storage as depicted. In addition, a table (not shown) may rest against the back wall 128*b* of the base unit 110 in the storage position 132. The tables 120, in one embodiment, are connected to the base unit 110 such that the tables may extend from the top of the base unit 110 to form a work surface. In the depicted embodiment, the tables 120 are connected to the base unit 110 by hinges 134 and rotate to an extended position.

Figure 1B:
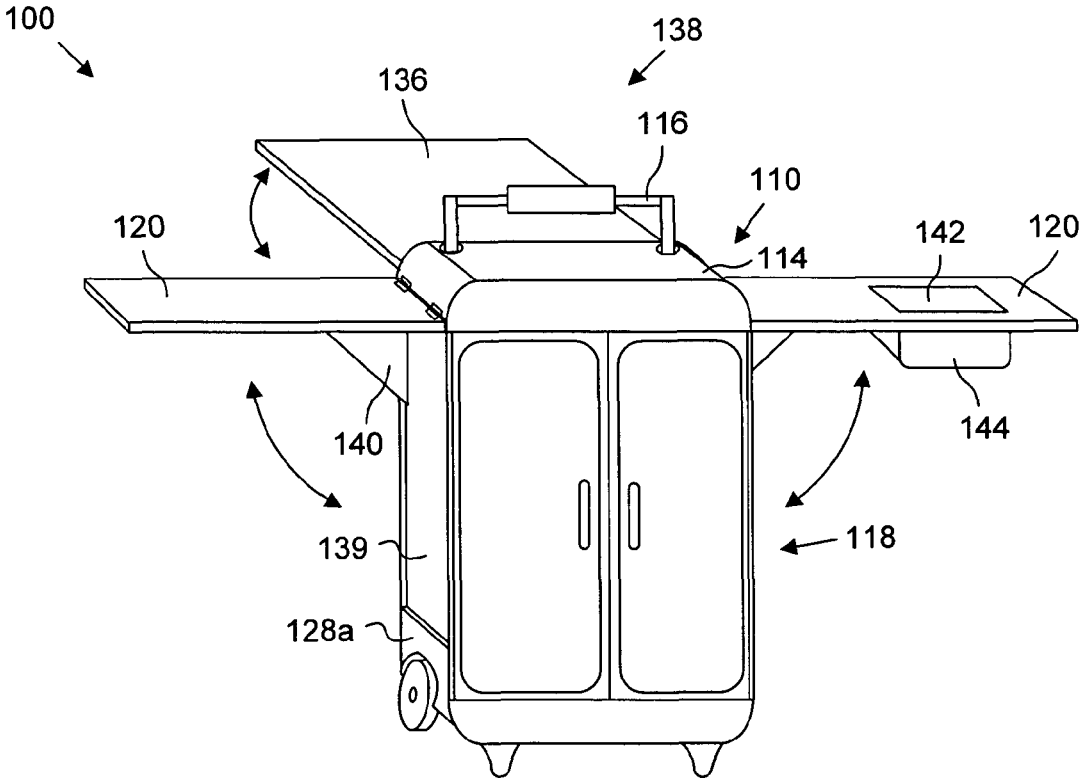
FIG. 1B is a perspective view illustrating one embodiment of the portable workstation of FIG. 1A with an extended table and side tables in accordance with the present invention.

FIG. 1B illustrates the workstation 100 with side tables 120 and a table 136 in an extended position 138. A support leg (not shown) extending to the ground supports the table 136. The extended tables 120, 136 provide amble work surface without compromising the storage capacity of the base unit 110. In the storage position 132, the tables 120, 136 may reinforce the structure of the base unit 110. In certain embodiments, a designated table storage area 139 maybe disposed along the wall 128*a* to store the tables 120, 136.

In the extended position 138, the table 136 and its support leg provide support to the base unit 110, similar to a tripod support system. Thus, items may be place on the platform 114 and/or side tables 120 without tipping over the base unit 110. In the depicted embodiment, the side tables 120 are supported by a wedge 140. The wedge 140 may be connected to the side table 120 by a hinge (not shown). If needed, a similar wedge 140 may provide added support to the table 136 in addition to the support leg. In certain embodiments, the handle 116 telescopically extends from the top of the base unit 110 to form a rack system (not shown). The rack system may be a stabilizing factor to the tripod support system under certain conditions.

In select embodiments, the workstation 100 may be configured to store and transport kitchen items. In one embodiment, the workstation 100 further includes an opening 142 in the side table 120 and/or platform 114 to receive a dishpan, forming a sink 144. The dishpan may be an eight to twelve quart vinyl plastic dishpan available at supermarkets such as Wal-Mart. In one embodiment, the dishpan, or sink 144, may be removed to be stored with the other kitchen supplies. Alternatively, the sink 144 may be collapsible and may be made from flexible material such as vinyl plastic. A collapsible sink 144 enables the side tables 120 to be stored against the side walls 128*a* or the like without requiring designated storage room for the sink 144.

Figure 1C:
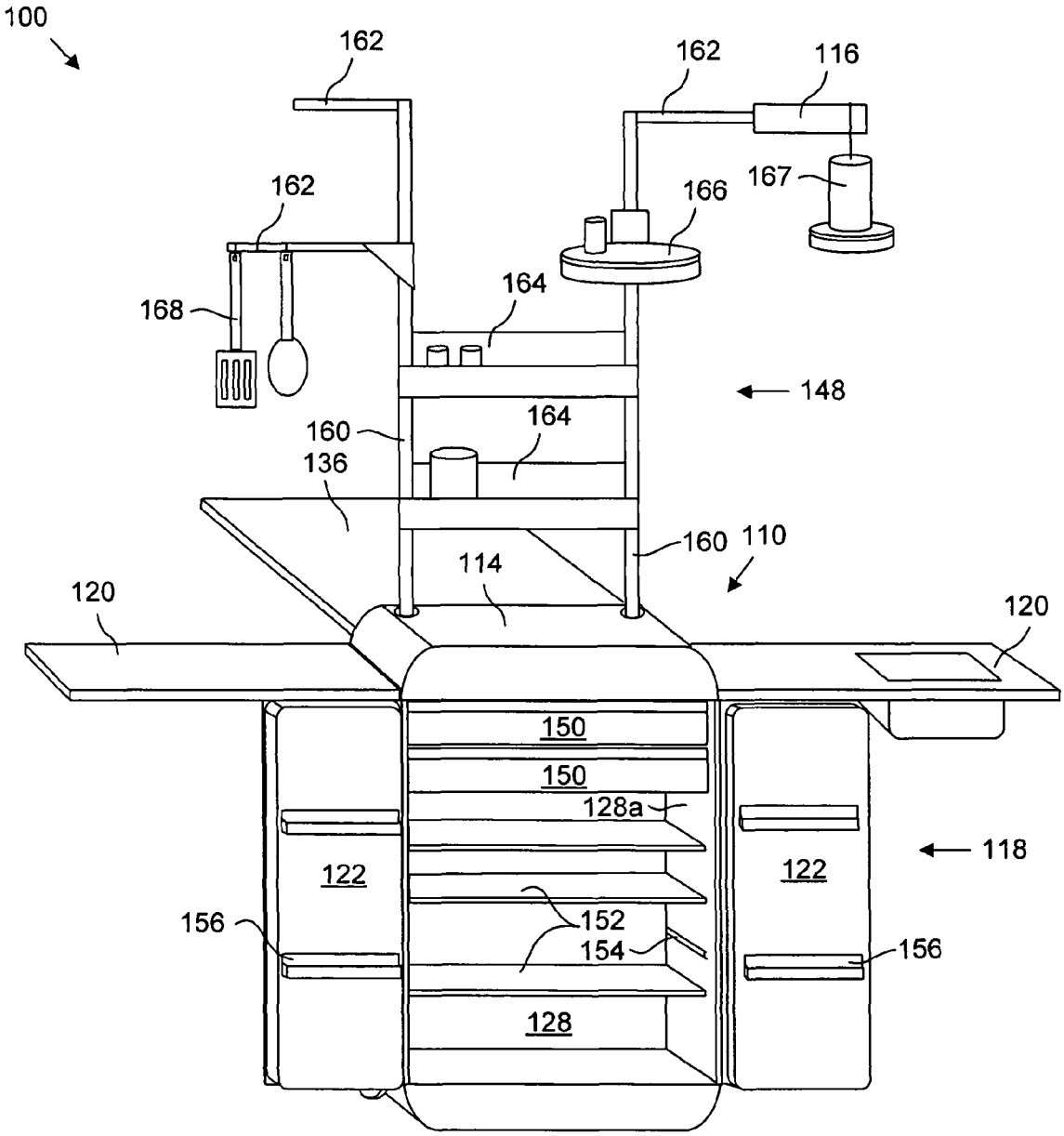
FIG. 1C is a perspective view illustrating one embodiment of the portable workstation of FIG. 1A with a rack system in accordance with the present invention.

FIG. 1C illustrates a workstation 100 with a rack system 148 and attached accessories. The rack assembly 148 and the storage compartment 118 maybe organized to resemble a kitchen cabinet and stove area. Within the storage compartment 118, drawers 150 may store utensils or the like and may be pulled out for easy access. Rigid shelves 152 may be installed between the rigid outer walls 128*a*. The outer walls 128*a* may include molded slots 154 to enable the user to adjust the height of the shelves 152. Smaller shelves 156 may be fastened to the doors 122, which may be pivotally attached to the outer walls 128*a*. The outer walls 128*a*, shelves 152, 156, and drawers 150 may be made from molded plastic.

The base unit 110 may provide additional kitchen functions as well. For example, the platform 114 may doubly function as a cutting board. The sturdy base unit 110 provides a strong support for a cutting surface, and the platform 114 may be made from a suitable material, such as plastic. In addition, in one embodiment, the base unit 110 may be configured to support a grill and/or camp stove in the extended position 138 without specifically designating a portion of the storage area or the work surface to a stove. Consequently, the user may choose to use or even to pack a stove because of the flexible storage arrangement, yet the base unit 110 may be thin, lightweight and portable in the storage position 132 because the stove is not built into the work surface.

The rack assembly 148 may include additional vertical supports 160, extensions 162, shelves 164, and a lazy Susan 166. The additional vertical supports 160 may be integrated into the handle 116 and may telescopically extend from an internal frame or from the support structure of the base unit 110. Alternatively, the additional vertical supports 160 may be attached to the platform 114 and/or walls 128 of the workstation 100. The additional vertical supports 160 may include one or more stops (not shown) or locking mechanisms to prevent the telescoping components from retracting.

The rack system 148 may increase the accessible storage area of the workstation 100. Accessories may be attached to the additional vertical supports 160. The lazy Susan 166 and the shelves 164, which may be made from molded plastic and may snap around the additional vertical supports 160, may provide additional area on which to set food, spices, utensils, etc. In certain embodiments, fasteners, such as hooks and loops, snaps, belts, etc., maybe used to secure the shelves 164 to the additional vertical supports 160. The extensions 162 may be used to hang items such as a lantern 167 and utensils 168.

Figure 1D:
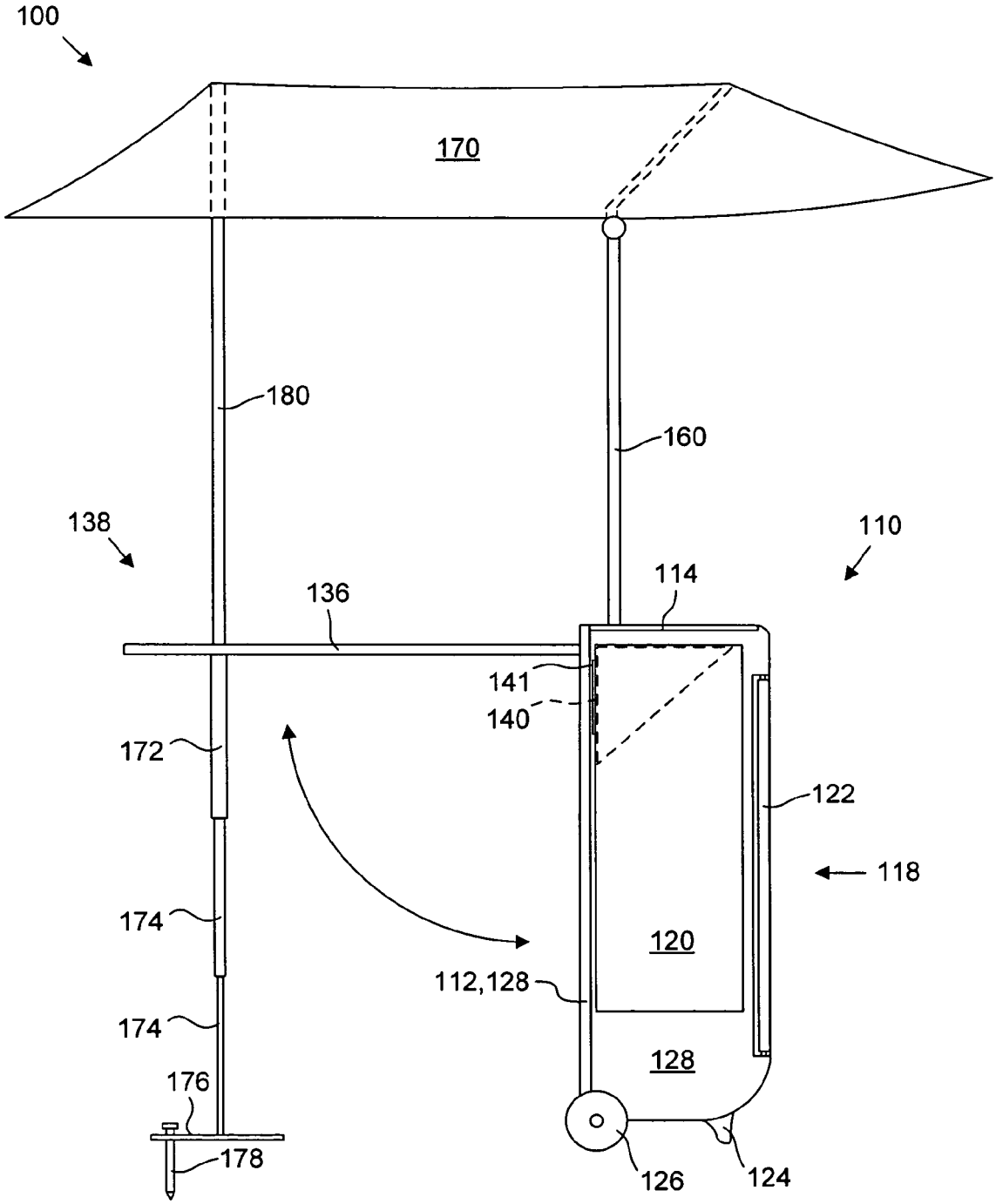
FIG. 1D is a side view illustrating one embodiment of the portable workstation of FIG. 1A with an attached umbrella in accordance with the present invention.

FIG. 1D illustrates a side view of one embodiment of a workstation 100 with an extended table 136 and an umbrella attachment 170. The table 136 may be hinged to the base unit 110. To transition from an extended position 138 to a storage position 132 (FIG. 1A), the table 136 may pivot downward to rest adjacent to the base unit 110 as mentioned above. Alternatively, the table 136 may be removable. In one embodiment, the table 136 snaps into place onto a support bar (not shown) or the like. Those of skill in the art will recognize that the table 136 may be connected to the workstation 100 by a variety of methods and/or fasteners.

The vertical support(s) 112 supports the table 136. The table 136 further includes an additional support leg 172 to fully support the table 136 in the extended position 138. The extended table 136 provides support to the base unit 110. In certain embodiments, the support leg 174 comprises one or more telescoping members 174 and a stabilizer 176. The telescoping members 174 may lock into place to secure the leg 172. In one embodiment, the stabilizer 176 is secured to the ground with a stake 178, weighted item, or other mechanism.

As mentioned, the vertical support(s) 112 and the support leg 172 form a tripod system to support the workstation 100. As a result, the workstation 100 is self-supporting and does not require an additional stand or the like to function effectively, thereby enabling the workstation 100 to be easily transported and set up. Beneficially, the depth of the base unit 110 may vary without affecting the stability of the workstation 100 or the working surface provided by the table 136. Thus, the base unit 110 may be compact for portability in the storage position 132; however, the workstation 100 may provide ample work space in the extended position 138.

The side tables 120 may be sectioned to preserve the compactness of the workstation 100. The side tables 120 will be discussed with greater detail in relation to FIGS. 7A-8. In the depicted embodiment, the wedge 140 includes a hinge 141 to enable the wedge 140 to fold against the side table 120 in the storage position 132.

Other accessories such as the umbrella 170 may attach to the additional vertical supports 160. In one embodiment, a support 180 extends between the umbrella 170 and the table 136 to support the umbrella 170, which may cover the majority of the table 136 and may be collapsible to fit within the storage compartment 118.

Figure 2:
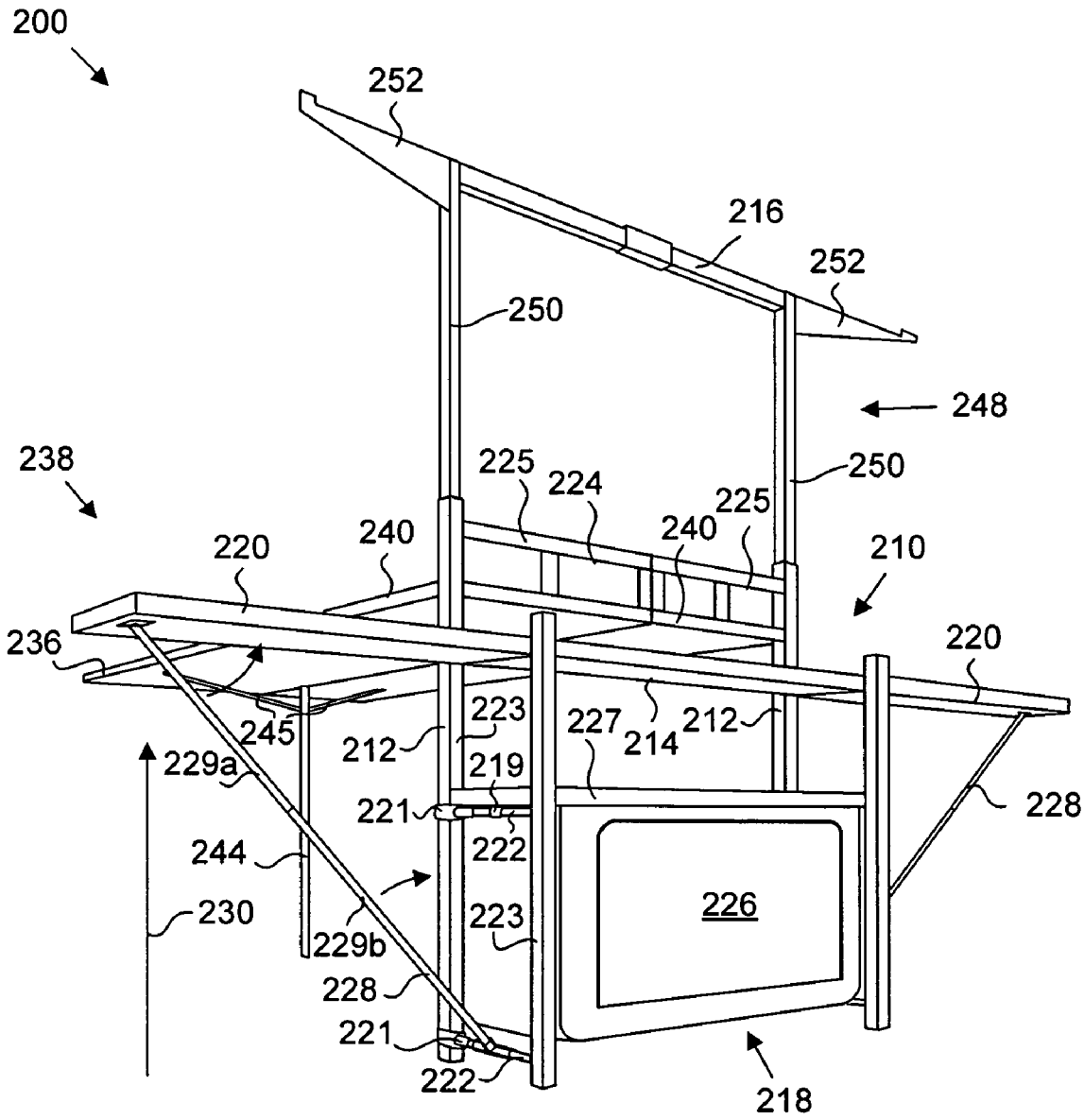
FIG. 2 is a perspective view illustrating an alternative embodiment of a portable workstation in accordance with the present invention.

FIG. 2 illustrates one embodiment of a collapsible workstation 200 in accordance with the present invention. The collapsible workstation 200 as depicted includes a base unit 210, vertical support members 212, a platform 214, an extendible handle 216, a storage compartment 218, side tables 220, a table 236, a rack system 248, and a support leg 244. The collapsible workstation 200 collapses to form a compact frame structure that is easily portable. The storage compartment 218 may comprise a removable soft cabinet 226 that will be described in greater detail with relation to FIGS. 7A-7D. The soft cabinet 226 may provide a shelf 227, or may attach to a shelf 227, that extends between two vertical support members 212 in certain embodiments.

The vertical support members 212 may comprise a frame structure. In the depicted embodiment, the vertical support member 212 includes two vertical posts 223 made of aluminum tubing or the like and connected by a plurality of rungs 222. The rungs 222 may provide support to one or more shelves 227, to the platform 214, and to the side tables 220. In one embodiment, the side tables 220 rotate around one of the rungs 222. In addition, the rungs 222 may include a fastener 221 to enable the vertical support member 212 to rotate to a storage position. The shelves 227 may include a fastener 219 to connect the shelf 227 to the rung 222. Alternatively, the shelves 227 may include a slot (not shown) to receive the rung 222.

The vertical support members 212 maybe connected by a connecting member 224, which may include a bar for attaching the table 236 in certain embodiments. In the depicted embodiment, the connecting member 224 is configured to fold and includes frame sections 225 that are hinged together. The back table 236 may also be sectioned to correspond to the frame sections 225 of the connecting member 224 to facilitate folding the collapsible workstation 200. The back table 236 may be hinged to the connecting member 224. The vertical support members 212 may rotate to fold against the connecting member 224. In certain embodiments, the connecting member 224 may further function as a windscreen or provide the structure to attach a windscreen. In one embodiment, a guard (not shown) covers the frame structure of the connecting member 224 to block wind from either the surface of the platform 214 or from the table 236.

The platform 214 may be removable and extends between the vertical support members 212 to form the top of the base unit 210, which is illustrated in an upright position 230. The side tables 220 extend from the base unit 210, extending the work surface of the platform 214 in certain embodiments. The side tables 220 may be supported by a prop 228 attached to a rung 222 of the vertical support member 212 as illustrated. The prop 228 may comprise two small shafts 229 of tubing. In one embodiment, the top shaft 229*a* connected to the side table 220 inserts into the bottom shaft 229*b* connected to the vertical support member 212 to form a continuous prop 228. The bottom shaft 229*b* may rotate to a vertical storage position parallel with the vertical support member 212. The top shaft 229*a* may be hinged to the side table 220 and may rotate to a storage position contiguous to the side table 220. The side table 220 may further rotate to a storage position adjacent to the vertical support member 212.

The table 236 is supported by the support leg 244 in the extended position 238. In certain embodiments, the table 236 includes separate slats 240. The support leg 244 may include supports 245 that extend to support a plurality of slats 240. The support leg 244 maybe removable for storage and may attach to the table 236 with a fastening device such as a clip, clamp, screw, or the like. As mentioned, the table 236 and support leg 244 provide support to the base unit 110 in the extended position 238.

The extendable handle 216 may function similar to the extendable handle 116 described in FIGS. 1A-1D. The rack system 248 may be formed using the telescoping members 250 for support. As mentioned, accessories (not shown) such as shelves, racks, a lazy Susan, or the like may be attached to the telescoping member(s) 250. In addition, the handle 216 may include an extension 252, which, in certain embodiments, extends outward to support additional items such as a lamp. The rack system 248 increases the storage area available to the user when the workstation 200 is set up for use. In certain embodiments, additional accessories for the rack system 248 may be stored for transport in the soft cabinet 226. The platform 214, the soft cabinet 226, and any shelves 227 may be removed before collapsing the workstation 200 for storage or transport.

Figure 3A:
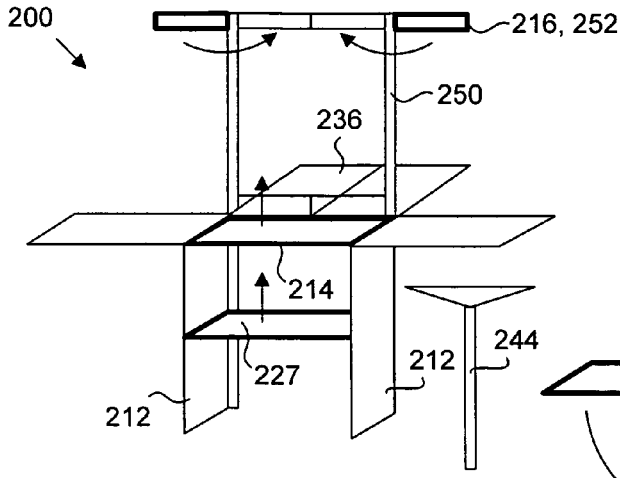
FIGS. 3A-3G are various perspective views illustrating a method for collapsing a portable workstation in accordance with the present invention.

FIGS. 3A-3G illustrate one method of collapsing one embodiment of the workstation 200 of FIG. 2. In FIG. 3A, the handle 216 and/or the extensions 252 maybe rotated into a storage position. The platform 214, which may comprise a shelf 227, and any additional shelves 227 extended between the vertical support members 212 maybe removed.

Figure 3B:
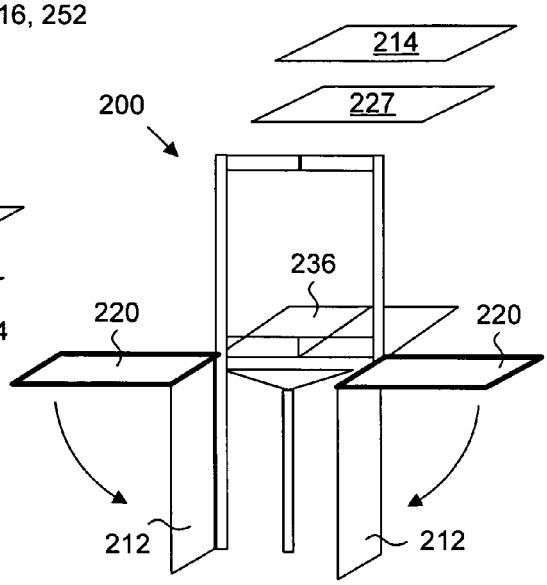

In FIG. 3B, any side supports, such as the prop 228 of FIG. 2, may be disassembled and transitioned to a storage position. The side tables 220, in certain embodiments, may rotate from a support or rung 222 of the vertical support member 212 to a storage position along the vertical support member 212. Alternatively, the side tables 220 may also be removed similar to the platform 214 and shelf 227.

Figure 3C:
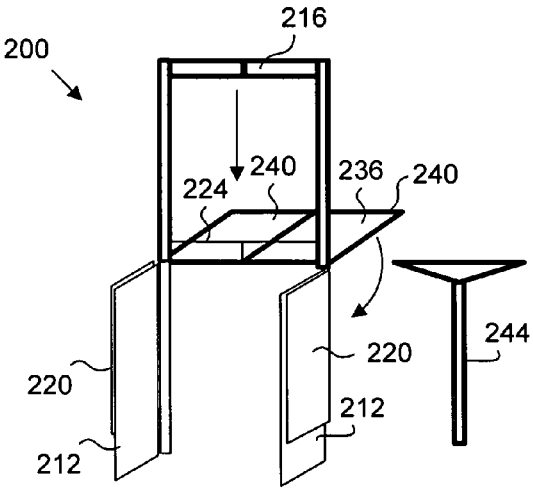

In FIG. 3C, the handle 216 may be lowered to a retracted position. The support leg 244 may be removed from the table 236, and the table 236 may be transitioned to a storage position. In one embodiment, the table 236 rotates around a support bar of the connecting member 224. Alternatively, the table 236 and slats 240, if any, may be removed and stacked with the platform 214 and any shelves 227.

Figure 3D:
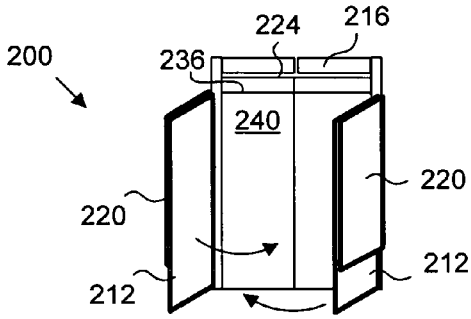

In FIG. 3D, the vertical support members 212 are rotated to a storage position against the collapsed table 236. The connecting member 224 provides support for the collapsed workstation 200.

Figure 3E:
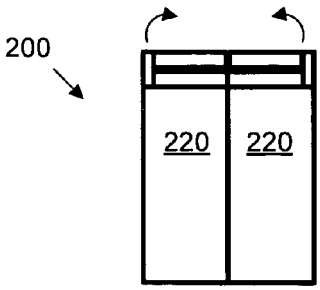
Figure 3F:
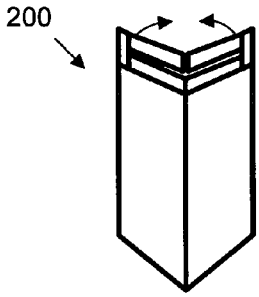
Figure 3G:
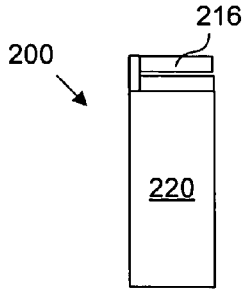

In FIGS. 3E-3F, the workstation 200 may be folded in half to produce the compact unit illustrated in FIG. 3G. The workstation 200 collapses to roughly the size of a slat 240 of the table 236 and/or the side tables 220.

Figure 4:
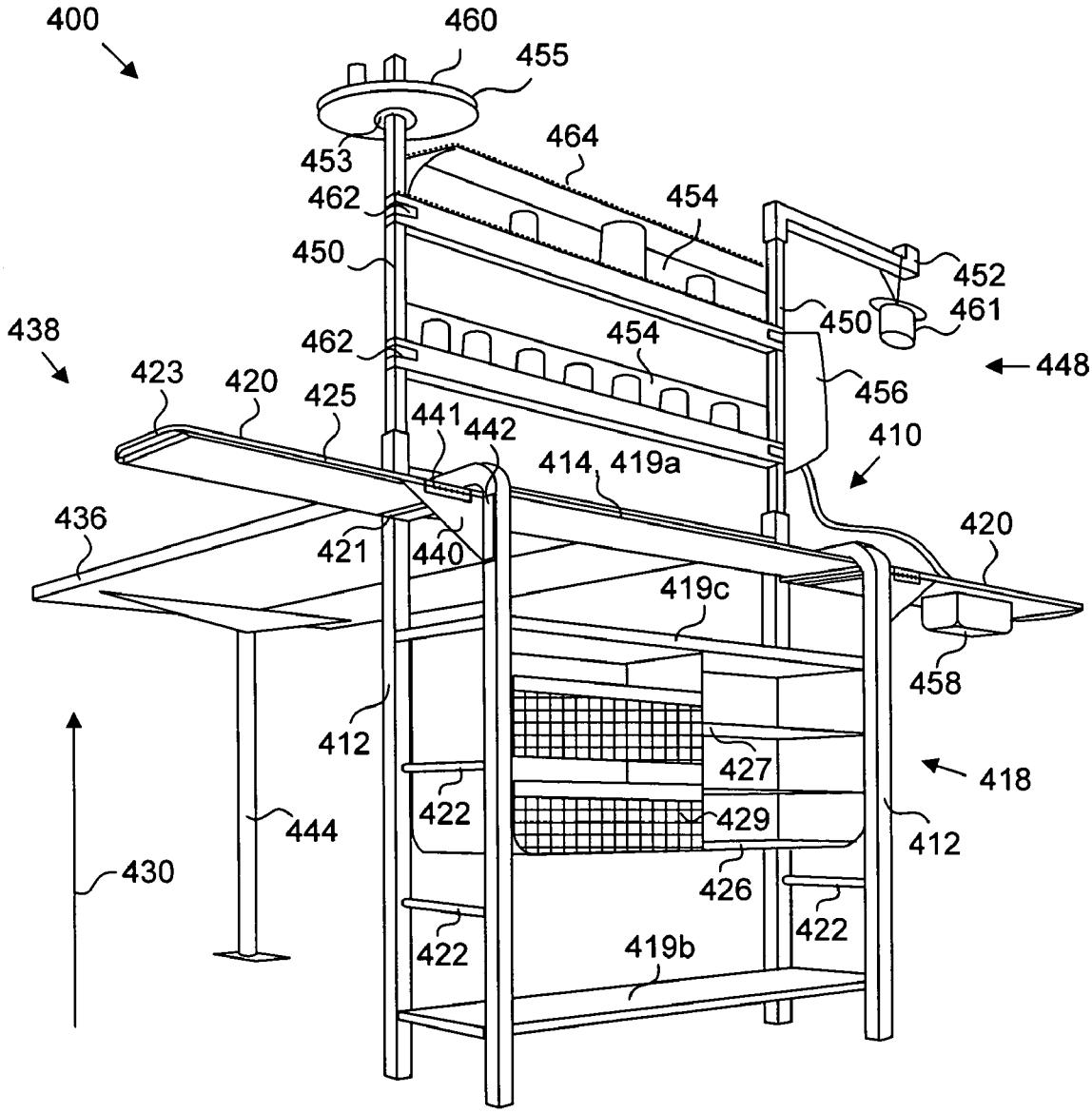
FIG. 4 is a perspective view illustrating another embodiment of a portable workstation in accordance with the present invention.

FIG. 4 illustrates an alternative embodiment of a collapsible workstation 400. The workstation 400 may be disassembled to enable the support structure and the additionally stored items to be easily transported separately. The workstation 400 may include a base unit 410 with vertical support members 412, a platform 414, a storage compartment 418, shelves 419, side tables 420, a table 436, and a rack system 448. The workstation 400 may further include a support leg 444, additional vertical supports 450, support extensions 452, one or more storage receptacles 454, a water container 456, and a sink 458. The workstation 400 may be similar to the workstation 200 described in FIG. 2. The workstation 400 as illustrated, however, is generally not configured to fold or to have rotating tables 420, 436. The workstation 400 may be completely disassembled to flat individual parts, with the exception of the storage compartment 418, storage receptacles 454 and any stored items and/or accessories.

The vertical support members 412, as illustrated, may be connected by rigid shelves 419 and a support bar (not shown). The shelves 419 may include a slot (not shown) to receive a rung 422. The platform 414 may comprise a shelf 419. In one embodiment, the workstation 400 includes a top shelf 419*a*, a bottom shelf 419*b*, and one or more middle shelves 419*c*. The shelves 419 may provide structural support to the workstation 400. The shelves 419 may form the storage compartment 418. In certain embodiments, the workstation 400 may further include an outer wall (not shown), which may be a single piece of fabric that may be wrapped around the vertical supports 412 to provide sufficient tension to hold the kitchen rack 400 together. The outer wall may provide a windscreen and protection for stored items as well. One embodiment of an outer wall is illustrated in greater detail in FIGS. 5E-5D.

The base unit 410, which includes the platform 414 and the vertical support members 412 fitted together in an upright position 430, enables a hanging cabinet 426 or the like to be suspended from the vertical support members 412. The hanging cabinet 426 may provide organization to the storage compartment 418. In one embodiment, the hanging cabinet 426 may be zippered closed to store kitchen items during transport. The user may subsequently install the hanging cabinet 426 for easy access when the workstation 400 is fully assembled. In one embodiment, the hanging cabinet 426 is suspended from hooks connected to the shelves 419 or to the rungs 422 of the vertical support members 412. The interior of the hanging cabinet 426 may include shelves 427, bins 429 or the like. The hanging cabinet 426 may be made from a soft or rigid material. In one embodiment, a nylon mesh retainer on the bin 429 provides flexibility to the bin 429 and permits the user to see stored items.

The rack system 448 may be similar to the rack systems 148, 248 illustrated in FIG. 1C and FIG. 2 respectively. The rack system 448 may include the additional vertical supports 450, the support extensions 452, and one or more storage receptacles 454. The additional vertical supports 450 may be inserted into and supported by the vertical support members 412. In certain embodiments, the rack system 448 may further include accessories such as an attachable, rotating lazy Susan 455. The lazy Susan 455 may include a swivel mechanism 453 that encompasses the additional vertical support 450 and enables rotation of a tray 460. The water container 456 may be attached to the additional vertical support 450 by a fastening mechanism (not shown), such as a hook, strap, or the like. In certain embodiments, the water container 456 drains into the sink 458 to enable easy access to water for cooking or cleaning or the like. In one embodiment, the support extension 452 is configured to support a light source 461, such as a lantern.

The storage receptacles 454, in one embodiment, comprise a zippered pouch 464 that may be used to enclose items for storage when not attached to the additional vertical supports 450. For example, the storage receptacles 454 may be stored within the bin 429 in the storage compartment 418 until the additional vertical supports 450 are extended to a support position. Fasteners 462, such as straps, hooks and loops, snaps, and the like, may be used to secure the storage receptacles 454 to the additional vertical supports 450. In a contemplated embodiment, the items for storage, such as spices, measuring cups, etc., are stored within the zippered pouch 464 such that the user is not required to transfer or arrange the items after the storage receptacles 454 is suspended from the additional vertical supports 450. Consequently, the stored items remain secure and organized, and the user can easily assemble or remove the accessories from the rack system 448.

The side tables 420 may extend from the vertical support members 412. The side table may include a slot 421, a wedge 440, a handle 423, and a frame 425. In the illustrated embodiment, the side table 420 is attached to a rung 422 by the slot 421 and is supported in an extended position by the wedge 440, which is hinged to the side table 420. The wedge 440 may include a hinge 441 and a stop 442 to catch on the vertical support member 412, thus preventing the side table 420 from slipping. In certain embodiments, the side table 420 includes a handle 423 for hanging items such as dish towels. The handle 423 may be made by extending the frame 425 of the side table 420 in one embodiment. The back table 436 may be attached to a support bar (not shown) and may include a similar support structure as the side tables 420. The support leg 444 supports the table 236 in an extended position 438.

Figure 5A:
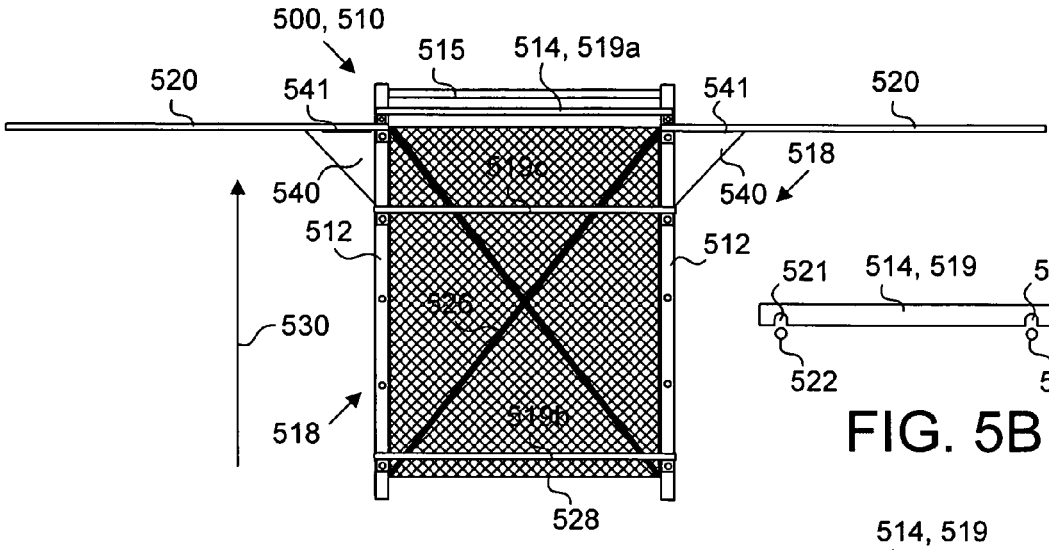
FIGS. 5A-5F are various side views illustrating components of one embodiment of a portable workstation in accordance with the present invention.
Figure 5B:
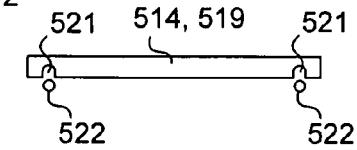
Figure 5C:
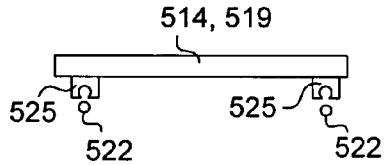

FIG. 5A illustrates a cross-sectional front view of one embodiment of a collapsible workstation 500 reinforced by an outer wall 528. The outer wall 528 is shown in greater detail in FIG. 5E. The workstation 500 comprises a base unit 510 in an upright position 530 with vertical support members 512, a platform 514, a support bar 515, shelves 519, side tables 520, and wedges 540 with hinges 541. The support bar 515 may support a table extending from the top of the base unit 510. The platform 514 may be similar to the shelves 519. In one embodiment, a plurality of shelves 519 provides major structural support to the base unit 510. The outer wall 528 provides tension to stabilize the base unit 510 and to retain the shelves 519 and the support bar 515. FIG. 5B and FIG. 5C illustrate two embodiments of shelves 519 with various connectors.

FIG. 5B illustrates one embodiment of a collapsible shelf 519 with a built in slot 521. The slot 521 is configured to receive a rung 522 or the like of a frame structure such as the vertical support member 512. FIG. 5C illustrates an alternative embodiment of a shelf 519 with a connecting device 525 attached to the exterior of the shelf 519. The connecting device 525 may function similar to the slots 521 in certain embodiments. In certain embodiments, the shelves 519 may easily snap onto the vertical support members 512, stabilizing the vertical support members 512 and providing storage and/or a working surface. In one embodiment, at least a top shelf 519*a* and a bottom shelf 519*b* stabilize the vertical supports 512, although additional shelves 519*c* may be added for support or storage. The workstation 500 may be sufficiently stable to support extended side tables 520, a rear table (not shown), a rack system (not shown) and filled storage compartments, such as the hanging cabinet 426 of FIG. 4. In one embodiment, the shelves 519 disposed along the vertical support member 512 define a storage compartment 518.

Figure 5D:
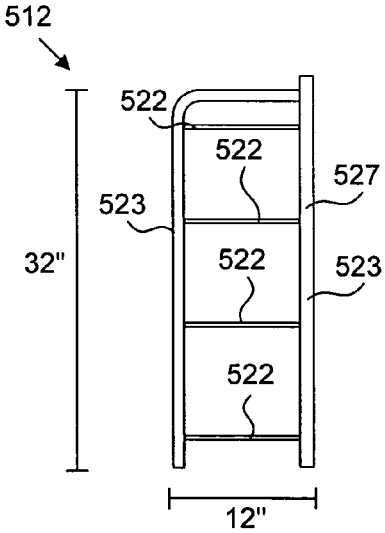

FIG. 5D is a side view illustrating one embodiment of the vertical support member 512 with a frame structure 527. The frame structure 527 may resemble a ladder with horizontal supports, or rungs 522 and vertical posts 523. In certain embodiments, the comers of the frame structure 527 may be curved. Alternatively, the frame structure 527 may simply comprise straight posts 523 (See FIG. 5F) connected by rungs 522, or another suitable support structure. The rungs 522, or horizontal supports 522 of the frame 525, may be alternatively configured as well. For example, the horizontal supports 522 may be crossed, diagonally arranged, or the like. In a contemplated embodiment, the vertical support member 512 is a simple, stable unit that does not require adjusting or assemblage, which eliminates the need for scissor mechanisms, locking mechanisms, or the like. Given by way of example, the vertical support 512 may be about 32" high and about 12" wide in one embodiment.

Figure 5E:
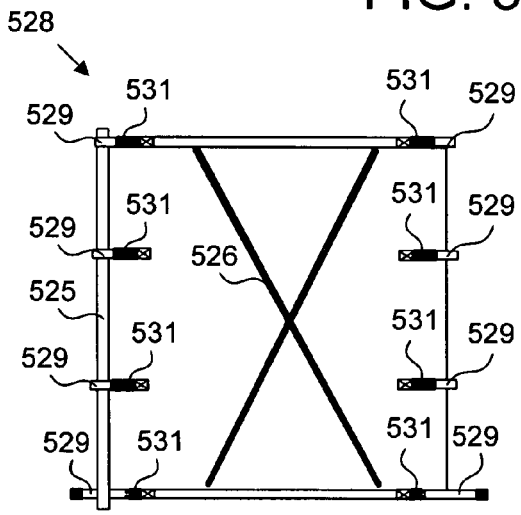

The outer wall 528 of FIG. 5E may be attached to the vertical support members 512 to provide tension and to retain the shelves 519 and vertical support members 512 in an upright position 530. The outer wall 528 may encompass three sides of the workstation 500 to define and/or shelter one or more storage compartments 518. In certain embodiments, the outer wall 528 functions as a windscreen. In one embodiment, the outer wall 528 is made of a lightweight, sturdy fabric, such as a 200 denier nylon fabric. A non-stretch fabric or ribbing 526 may be used to reinforce the fabric. The ribbing 526 may be crossed run from one vertical support 512 to another vertical support 512.

In the depicted embodiment, the outer wall 528 comprises a rectangular fabric panel with straps 529. The straps 529 may comprise a fastener 531, such as a quick release clip, hooks and loops, a buckle, snaps, and the like, and may be used to fasten the outer wall 528 to the vertical support member 512. In certain embodiments, the straps 529 may be wrapped around the post 523 of the vertical support member 512.

Figure 5F:
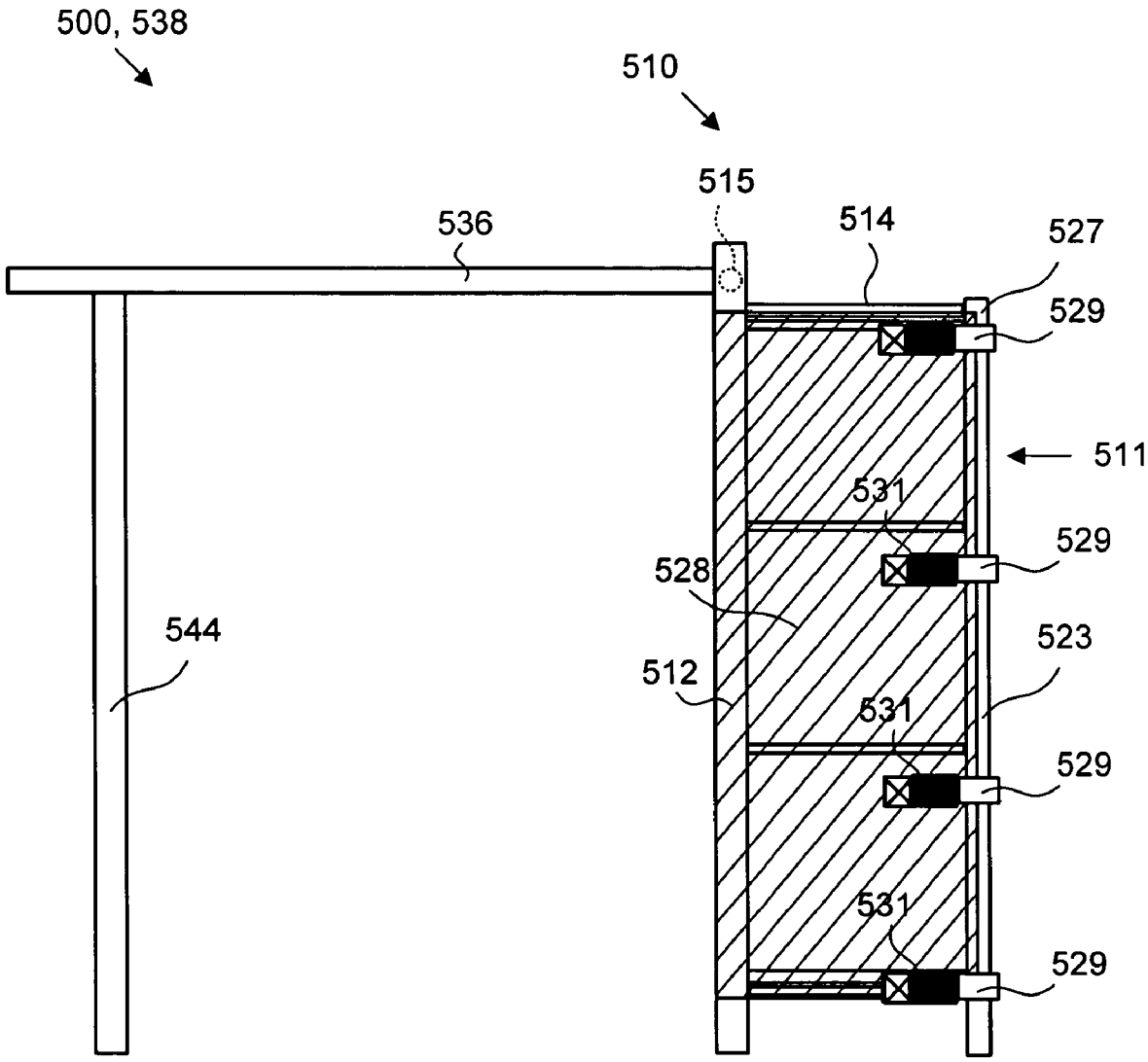

FIG. 5F illustrates in greater detail one embodiment of the outer wall 528 fastened to the vertical support member 512. The outer wall 528 maybe wrapped around the exterior of the base unit 510 to enclose the base unit 510 on three sides, leaving an open front 511. The straps 529 may be fastened around the frame 527 or posts 523 of the vertical support member 512 with fasteners 531. The table 536 maybe connected to the bar support 515 and supported by the leg 544.

Figure 6A:
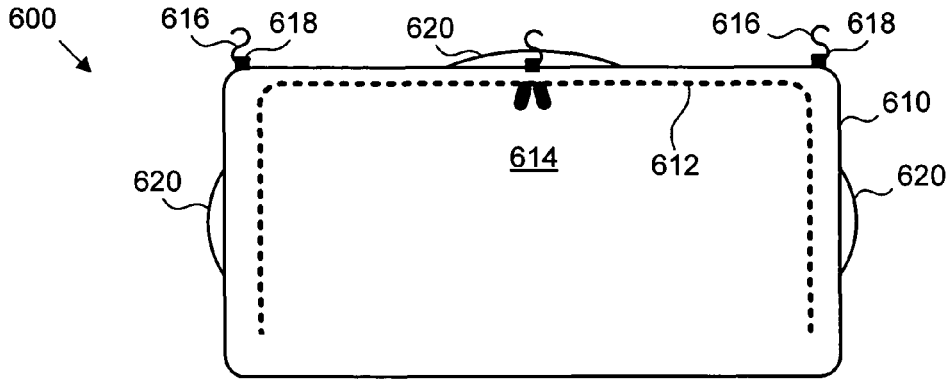
FIGS. 6A-6B are front views illustrating one embodiment of a hanging soft cabinet in accordance with the present invention.
Figure 6B:
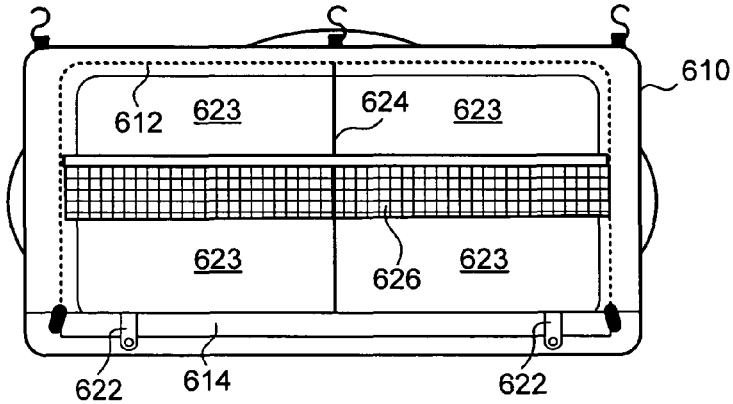
Figures 6C, 6D:
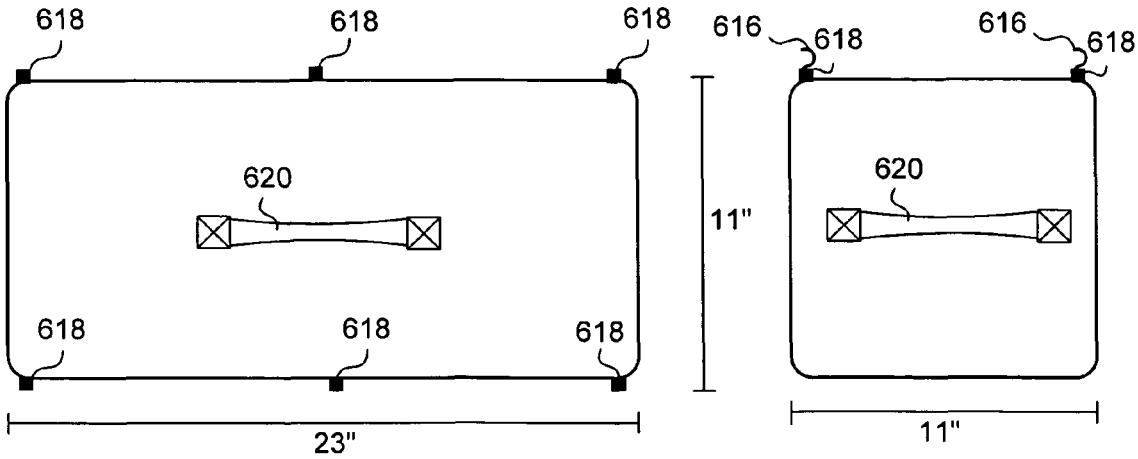
FIG. 6C is a side view illustrating one embodiment of a hanging soft cabinet in accordance with the present invention.
FIG. 6D is an end view illustrating one embodiment of a hanging soft cabinet in accordance with the present invention.

FIGS. 6A-6D illustrate one embodiment of a hanging soft cabinet 600 in accordance with the present invention. FIGS. 6A-6B are a front view, FIG. 6C is a plan view, and FIG. 6D is an end view. The hanging soft cabinet 600, as depicted, includes an outer shell 610, a zippered opening 612, a flap 614, hooks 616, hook attachments 618, handles 620, a flap constraint 622, a vertical divider 624, and a horizontal divider 626. The hanging soft cabinet 600 may be suitable for indoor or outdoor use. The outer shell 610 may be made of nylon and the zipper opening 612 may comprise a nylon coil zipper. When closed for storage and/or transportation, the hanging soft cabinet may appear similar to a duffle bag.

FIG. 6B illustrates the hanging soft cabinet 600 with the zippered opening 612 unzipped and the flap 614 rolled down and retained by the flap constraint 622. In the depicted embodiment, the vertical divider 624 and the horizontal divider 626 divide the inner chamber into four storage compartments 623. The vertical divider 626 may comprise a nylon panel for stability, and the horizontal divider 626 may comprise a nylon mesh panel for flexibility. In addition, the nylon mesh, which may retain a variety of stored items, such as dishes, pots, utensils, etc., further enables the user to view items in all storage compartments 623. Those of skill in the art will recognize that the storage compartments 623 may be configured to accommodate a variety of storage needs. Furthermore, the hanging soft cabinet 600 may be configured to store a storage receptacle 454 (See FIG. 4).

FIGS. 6C and 6D illustrate the hooks 616, hook attachments 618, and handles 620. The hooks 616 may hang from a shelf 519 or the like or from the frame 527 or rungs 522 of a vertical support member 512 in certain embodiments. The handles 620 may be disposed on the top and sides of the hanging soft cabinet 600 to facilitate transportation of the hanging soft cabinet 600. The handles 620 and the hook attachments 629 may be made from nylon webbing. The hanging soft cabinet 600 may contribute to the overall portability of a portable workstation. Given by way of example, the dimensions of the hanging soft cabinet 600 may be about 11 in.×11 in.×23 in.

Figure 7A:
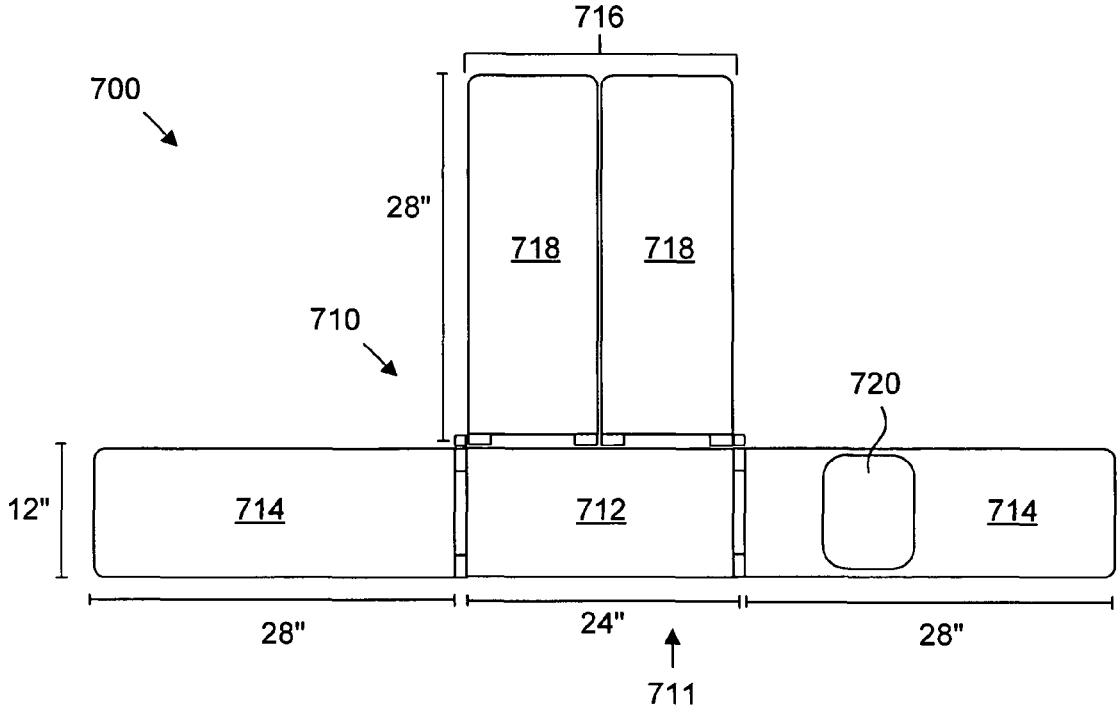
FIG. 7A is a plan view illustrating one configuration of tables of a workstation in accordance with the present invention.

FIG. 7A illustrates a plan view of one embodiment of a collapsible workstation 700. The workstation 700 includes a base unit 710, a platform 712, side tables 714, a table 716, slats 718, and an opening for a sink 720. The platform 712 may be built-in, removable and/or collapsible. In certain embodiments, the platform 712 may be aligned with the side tables 714, creating a flat working surface that includes the length of the left and right side tables 714 and the platform 712. Given by way of example, the length of the work surface area may span about seventy to eighty inches in certain embodiments. In one embodiment, the platform 712, which may be similar to a shelf, is about twenty-four inches long and about twelve inches wide. In certain embodiments, the slats 718 are the same size as the side tables 714 and may be interchangeable. Given by way of example, the side tables 714 and slats 718 may have a width of about twelve inches and a length of about twenty-eight inches. In certain embodiments, the table 716 is a single unit. Alternatively, the table 716 may comprise slats 718 that are hinged together to form a single unit.

Of note, the side tables 714 do not necessarily extend directly or evenly from the platform 712. The side tables 714 may conceivably extend at an angle to the platform and/or rotate in a horizontal plane. Furthermore, one or more additional tables 714, 716 may be extended from the opposite side (or front 711) of the platform 712. Therefore, the invention is not limited to the illustrated table configuration.

The available working surface area, including the table 716, preferably provides ample room on which to place dinnerware, cook ware, grills, books, games, etc. In one embodiment, the extended tables 714, 716 may provide over 1300 square inches of working surface area. The platform 712 may notably be made of a durable plastic material such as that used for cutting boards and may be sufficiently stable for dicing, chopping, slicing food, etc. Accordingly, the workstation 700 may be used to prepare food, perform field research, work with tools, type on a computer, or the like. The convenience provided by the extendable tables 714, 716 and available storage area may benefit a user in a variety of activities.

Figure 7B:
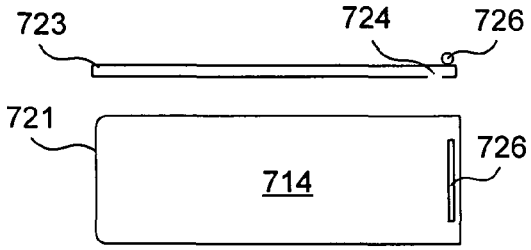
FIG. 7B is a plan view and a side view illustrating one embodiment of a side table of a workstation in accordance with the present invention.
Figure 7C:
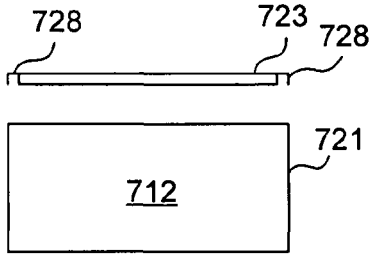
FIG. 7C is a plan view and a side view illustrating one embodiment of a platform of a workstation in accordance with the present invention.

FIG. 7B and FIG. 7C illustrate in greater detail a plan view 721 and a side view 723 of one embodiment of the side table 714 and the platform 712 respectively. The side table 714 includes a slit 724 and a platform connector 726 to connect the side tables 714 and platform 712 to the workstation 700. In one embodiment, the side tables 714 and/or slats 718 connect to the vertical supports members 512 by sliding onto a designated support or support bar 515. In one embodiment, a C-channel may be formed in the side table 714 to retain the support bar 515 or the like once the support bar 515 has entered through the slit 724. In addition, a brace, wedge 440, prop 228 or the like may provide support to the table 714 in an extended position. The platform connector 726 may comprise a bar attached to the side table 714. Those of skill in the art will recognize that the table 716 and side table 714 may be attached using a variety of mechanisms. The present invention, therefore, is not limited to the illustrated embodiments.

The platform 712 may also comprise a C-channel 728 to receive the platform connector 726. Accordingly, the platform 712 may be easily installed by fitting the C-channel 728 to the platform connector 726, or to a horizontal support or rung 522. In certain embodiments, one or more platforms 712 may be attached to the vertical support members 512. In an alternative embodiment, the platform 712 comprises a plurality of slats or sections to facilitate transporting the workstation 700.

Figure 7D:
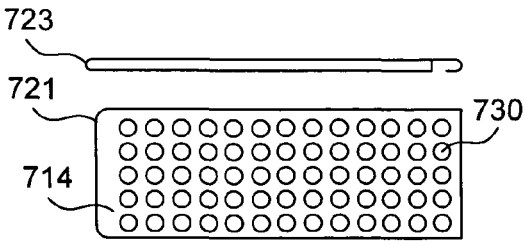
FIGS. 7D-7E are plan views and side views illustrating various embodiments of a side table in accordance with the present invention.
Figure 7E:
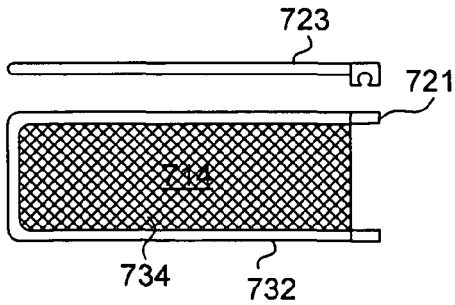

FIG. 7D and FIG. 7E illustrate a plan view 721, a side view 723 of alternative embodiments of the side table 714. In one embodiment, the side table is made of aluminum or extruded plastic with punched holes 730 to lighten the side table 714. In another embodiment, the side table 714 may be made of a rigid frame 732 with a tautly stretched material, fiber, or filament 734 similar to a tennis racquet or snowshoe.

Figure 8:
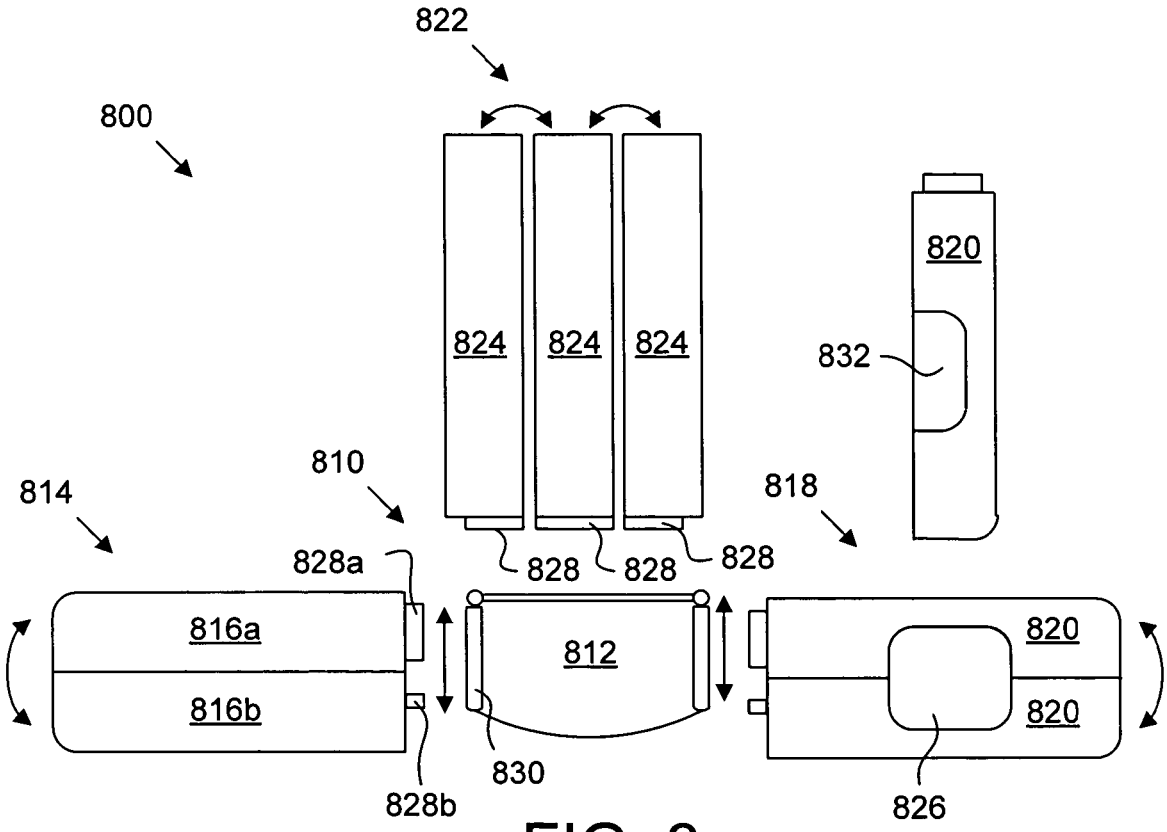
FIG. 8 is a plan view illustrating one embodiment of tables of a workstation in accordance with the present invention.

FIG. 8 illustrates a plan view of yet another embodiment of a workstation 800 in accordance with the present invention. The workstation 800 includes a base unit 810, a platform 812, a side table 814, slats 816, a side table 818, a table 818, slats 820, a table 822, slats 824, an opening 826 for a sink, tubes 828, and a frame structure 830. The tables 814, 818, and 822 may be sectioned for easy transportation. In one embodiment, the slats 816, 820, 824 are hinged together respectively and may be folded lengthwise to decrease the width of the tables 814, 818, 822. Thus, the tables 814, 818, 822 may be compact for transport, but still provide an ample working surface when completely assembled.

In one embodiment, the side table 814 comprises one or more tubes 828 to connect the side table 814 to the frame structure 830. The tubes 828 may be configured to slide along the frame structure 830 in order to release the tube 828*b*, thereby enabling the slat 816*b* to fold onto the slat 816*a*. The side table 818 maybe configured similarly. In addition, the slats 820 may include a cut-out portion 832 to form an opening 826 for a sink. In certain embodiments, the slats 816, 820, 824 may be configured to stack on top of each other.

Figure 9A:
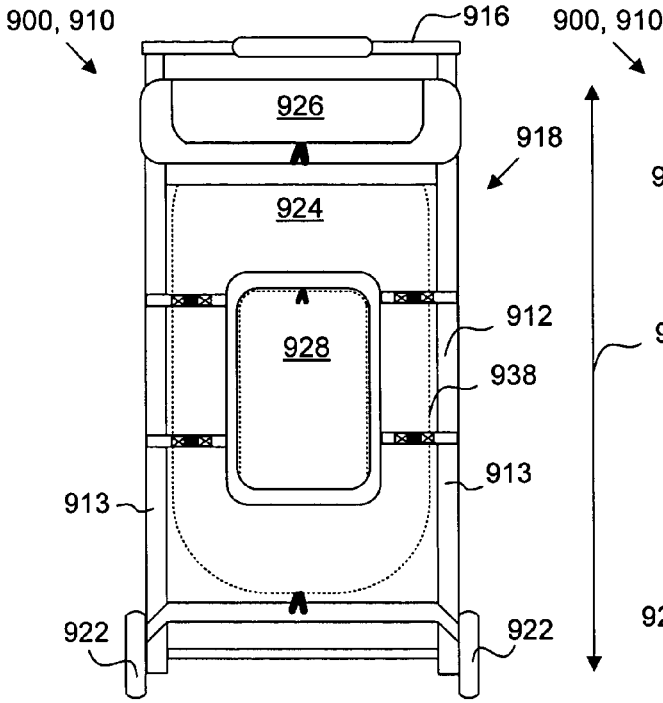
FIGS. 9A-9D are side views illustrating one embodiment of a workstation with an external frame in accordance with the present invention.
Figure 9B:
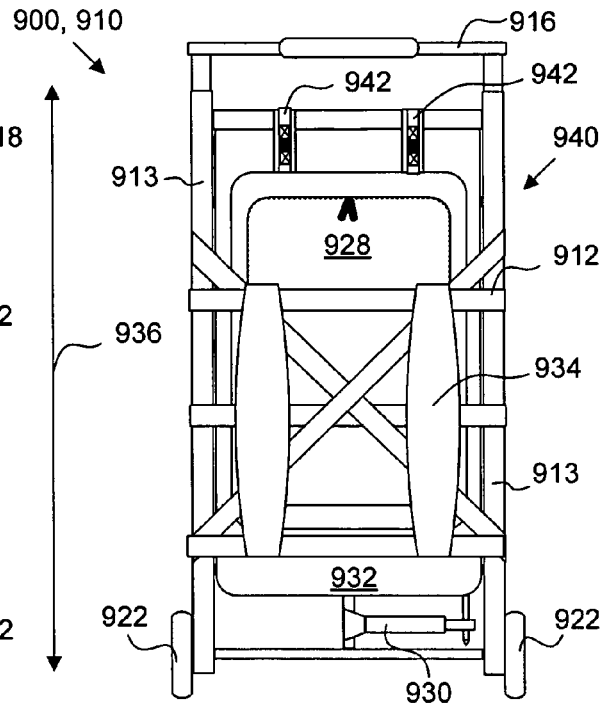
Figure 9C:
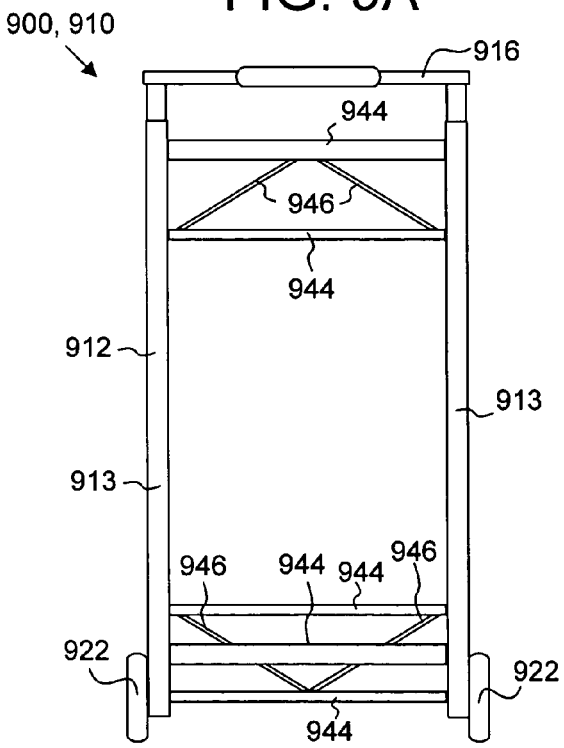
Figure 9D:
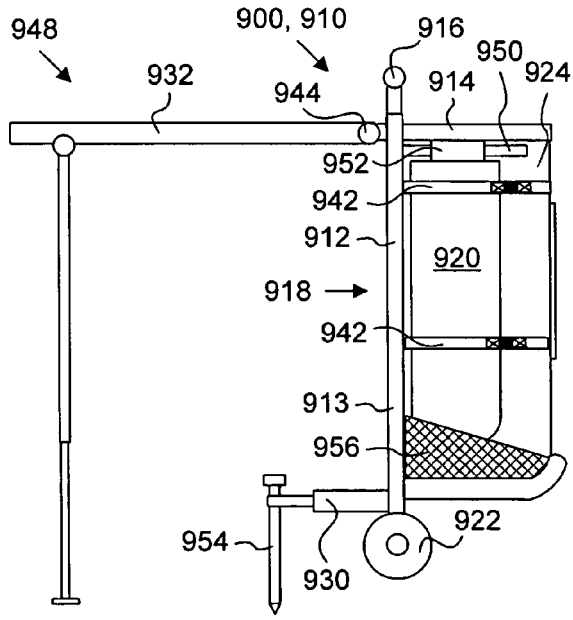

FIGS. 9A, 9B, and FIG. 9D depict a front view, a rear view, and a side view respectively of one embodiment of a portable workstation 900. FIG. 9C illustrates a back view of one embodiment of a vertical support member 912, or the frame structure 912 of the workstation 900. The workstation 900 may include a base unit 910, a frame structure 912, a platform 914, a handle 916, a storage compartment 918, a side table 920, wheels 922, an outer wall 924, a zipper storage bag 926, external storage compartments 928, a stabilizer 930, and an extendable table 932. The workstation 900 may provide storage and a work surface to enhance food preparation, field research, or the like in a primitive or rustic environment.

The depicted workstation 900 may resemble, in certain aspects, a framed backpack traditionally used by hikers. In certain embodiments, the workstation 900 may additionally include backpack straps 934 to facilitate transporting the workstation 900. In certain embodiments, the backpack straps 934 may attach to the frame structure 912. Alternatively, the handle 916 and wheels 922 may enable the user to roll the workstation 900, similarly to a wheeled piece of luggage known in the art.

The frame structure 912, which maybe internal or external, provides support and structure to the workstation 900 and contributes to the portability of the workstation 900. A user may easily lift and manipulate the workstation 900. In one embodiment, the workstation 900 comprises a single rectangular frame 912 as depicted. Alternatively, the workstation 900 may comprise multiple frame structures 912. In one embodiment, the frame 910 is made from hollow aluminum tubing, which is lightweight and durable, though any rigid material that provides support may be suitable.

In certain embodiments, the frame structure 912 comprises a plurality of vertical supports 913 strategically spaced to create a storage area. In certain embodiments, the frame structure 912 may comprise two vertical supports 913, or vertical support members 912 in certain embodiments, spaced about thirteen to twenty-two inches apart. In addition, the frame structure 912 may be latticed and may contain multiple framing components, though the framework is preferably kept at a minimum to reduce unnecessary bulk and weight. Given by way of example, preferred dimensions of the workstation may be eight to twelve inches deep by thirteen to twenty-two inches wide by twenty-three to thirty-six inches high, with a preferred dimension of ten inches by eighteen inches by thirty-four inches excluding the handle 916.

Because the workstation 900 may maintain a substantially vertical orientation, or upright position 936, during use and transportation, the workstation 900 may functionally maintain relatively minimal dimensions and may make use of ultra light yet economical materials like nylon pack cloth, while still retaining internally stored items in an organized manner. The vertical orientation also enables the workstation 900 to be easily packed into a car, boat, etc. The user may simply pack needed items, transport the workstation 900 where desired, extend the tables 920, 932, and effectively use the available working surface area, either to prepare food or for other activities. The vertical orientation further enables the user to easily access stored items throughout the entire process.

The outer wall(s) 924, which preferably encase or define an internal storage area, may be internal or external with respect to the frame structure 912. In one embodiment, the outer walls 924 may be made from fabric such as nylon, polyester, vinyl, or the like and may include zippers 938 to access the internal storage area, or storage compartment 918. Fabric outer walls 924 may contribute to the overall portability of the workstation 900, as fabric is generally durable, lightweight and flexible. Alternatively, the outer walls 920 may be made from a more rigid material such as plastic, as described above with respect to FIGS. 1A-1D.

In addition, the workstation 900 may include pockets, bags, or the like to provide additional storage. The additional external storage compartments 928 may be integral to the outer wall 924 or may be subsequently attached to the outer wall 924 or frame structure 912. The depicted workstation 900 comprises a zipper storage bag 926 and a plurality of external storage compartments 928. The zipper storage bag 926 may be detachable and may be adjustable to suit the user's need for additional storage. In one embodiment, the external storage compartment 928 may provide additional storage for larger items such as grills, griddles, cutting boards, etc. The additional storage may be removed for the sake of portability or convenience.

In certain embodiments, the back of the workstation 900 may also include a removable external storage compartment 928. In certain embodiments, the external storage compartment 928 may be attached over the extendable table 932, which may be pivotally connected to the frame structure 912, in certain embodiments, and may be stored in a vertical storage position 940. Straps 942 or other devices may be used to secure the tables 920, 932 during storage and transportation.

The frame structure 912, as illustrated in FIG. 9C, supports the platform 914, tables 920, 932, and the storage compartment 918. In the depicted embodiment, the tables 920, 932 pivotally connect to the frame structure 912. The frame structure 912 may additionally include horizontal support members 944 and angled support members 946. In one embodiment, tables 920, 932 and/or platform 914 maybe installed as the frame structure 912 is assembled. Alternatively, the tables 920, 932 and or slats (not shown) may be removable. In one embodiment, the horizontal support members 944 maybe made of tubing that may be inserted into the tubing 828 (See FIG. 8) of the table slat 824 such that the table slat 824 may pivot around the horizontal support member 944. One or more walls 924 maybe attached to the frame structure 912. Consequently, items maybe stored between the vertical supports 913.

FIG. 9D illustrates in greater detail the workstation 900 with the rear table 932 in an extended position 948. The frame structure 912 may include an additional horizontal support 950 for supporting the side table 920. In one embodiment, the tubing 952 of the side table 920 and additional horizontal support 950 may include slots (not shown) to receive a pin or the like to lock the side table 920 into place. The platform 914 may be connected to the frame structure 912 such that the platform 914 is level with or above the side tables 920 in an extended position.

In addition, the frame structure 912 may include a stabilizer 930 or other securing mechanism to stabilize the frame 912 of the workstation 900 when in use. The stabilizer 930 may be particularly useful for workstations 900 with wheels 922. In the depicted embodiment, the stabilizer 930 comprises a stake 954.

The tables 920, 932 may be secured to, or transported with, the workstation 100 using a variety of methods. In one embodiment, the workstation 900 includes a pocket or table port 956 made of nylon mesh or other material to retain the ends of the tables 920, 932. Alternatively or in addition, straps 942 with a fastener, such as hooks and loops, a buckle, or the like, may also secure the tables 920, 932 to the workstation 900. In one embodiment, the straps 942 used to attach the external storage compartment 928 may also secure the tables 920, 932. In an alternative embodiment, the tables 920, 932 may be transported separately from the workstation 900.

Figure 10:
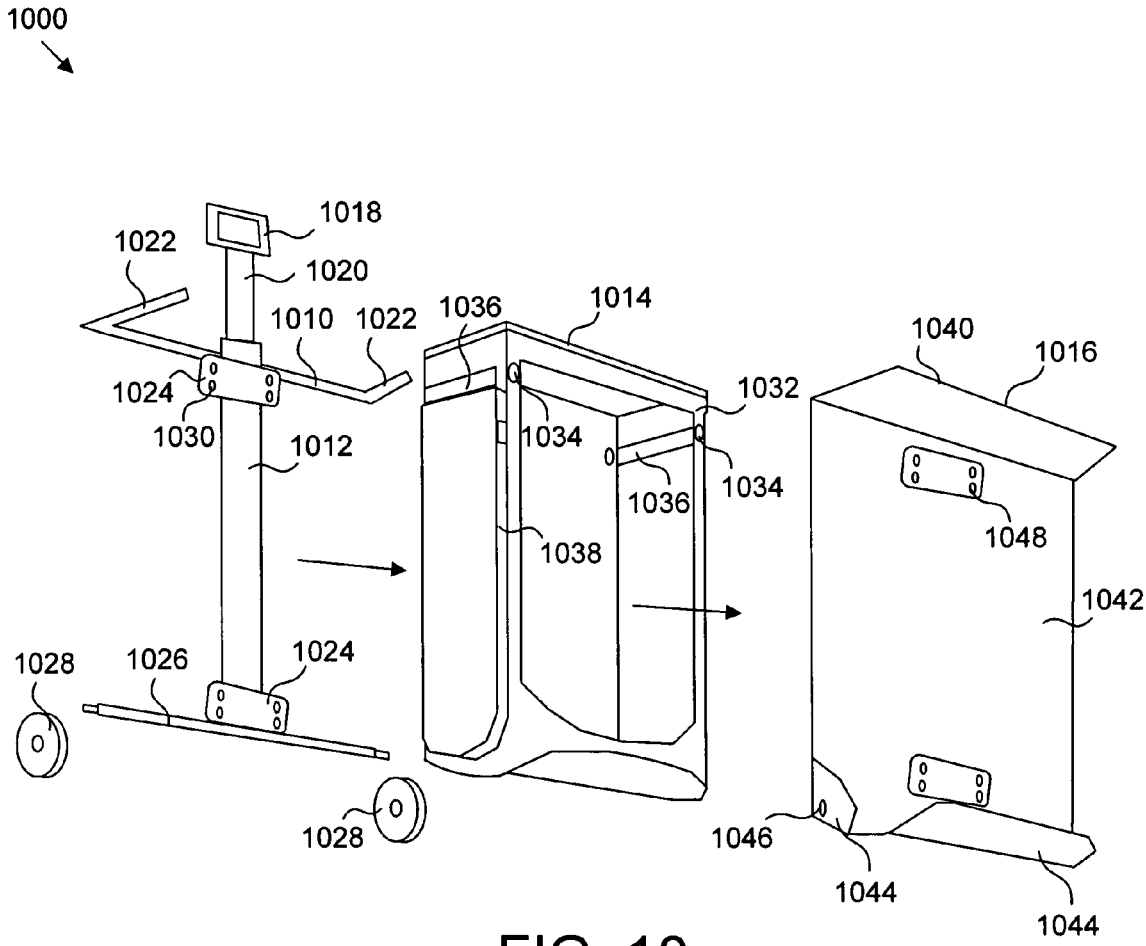
FIG. 10 is an exploded view illustrating one embodiment of a base unit with a single vertical support member in accordance with the present invention.

FIG. 10 illustrates an exploded view of one embodiment of a base unit 1000 with an external frame 1010 in accordance with the present invention. The base unit 1000, as depicted, includes the external frame 1010 with a single vertical support member 1012, a platform 1014, and an insert 1016. The insert 1016 may provide support to the platform 1014 and give shape to the base unit 1010.

The external frame 1010 may further comprise a handle 1018, an additional vertical support 1020, side supports 1022, insert connectors 1024, and an axle 1026 for wheels 1028. The handle 1018 may be connected to the additional vertical support 1020, which may telescopically extend from the vertical support member 1012 to support a rack system (not shown). The plurality of arm supports 1022 may support the platform 1014 and any side tables (not shown), including an extending table supported by a support leg (not shown). The insert connectors 1024 may include holes 1030 for attaching the insert 1016 with a nut and bolt assembly or the like. The external frame 1010 may be made of aluminum to provide a lightweight support system. Wheels 1028 may facilitate transporting the base unit 1000.

The platform 1014 may be integrated into an outer wall 1032. Alternatively, the platform 1014 may be attachable. The outer wall 1032 may be made of nylon, polyester, or plastic in certain embodiments. In addition, the outer wall 1032 may include holes 1034 for receiving the side supports 1022 and slots 1036 for enabling attachment of side tables to the side supports 1022. In certain embodiments, the outer wall 1032 may further include a pocket 1038 or the like for retaining a side table or other items.

The insert 1016 may provide structure and support for a storage compartment and may be made of a sturdy material, such as aluminum or molded plastic. The insert 1015 may include a top support 1040, which may additionally comprise the platform 1014 in certain embodiments, a back support 1042, a bottom support 1044, and a reinforced side 1046. The insert 1016 may further include additional shelves or drawer supports and drawers (not shown) to provide an organized storage area. The outer wall 1032 may provide a covering for the shelves or the like. The reinforced side 1044 may include a hole 1046 for inserting the axle of the wheel 1028.

In certain embodiments, the bottom support 1044 and the reinforced side 1046 may replace the axle 1026. In another embodiment, the bottom support 1044 extends from about the middle of the vertical support member 1012 to support drawers or the like. Consequently, the external frame 1010 may provide additional frame members to support the bottom of the base unit 1000. Alternatively, the outer wall 1032 may provide a bottom wall as well. Holes 1048 may be reinforced to facilitate attaching the insert 1016 to the external frame 1010. The base unit 1000, as illustrated, may provide a lightweight, compact and sturdy support structure for a workstation with tables as described in previous embodiments.

Figure 11:
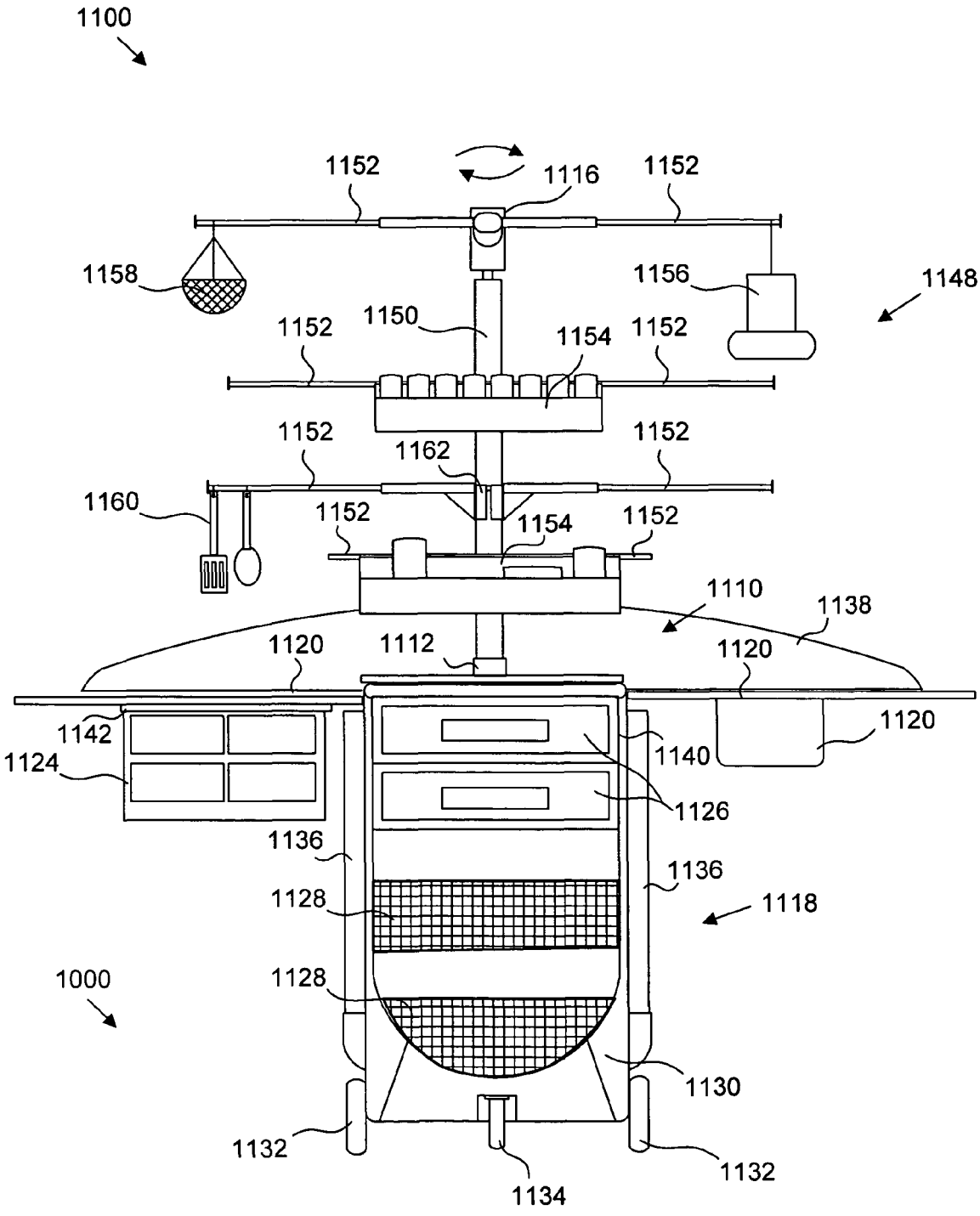
FIG. 11 is a front view illustrating one embodiment of a workstation with a rack system in accordance with the present invention.

FIG. 11 illustrates one embodiment of a portable workstation 1100 with a rack system 1148. The workstation 1100, as depicted, includes a base unit 1110, a single vertical support member 1012, a platform 1014, a handle 1116, a storage compartment 1118, side tables 1120, a sink 1122, a portable pantry 1124, drawers 1126, mesh storage bins 1128, an outer wall 1130, wheels 1132, a stand 1134, table ports 1136, and a windscreen 1138. The workstation 1100 and base unit 1110 may structurally resemble the base unit 1000 of FIG. 10.

An insert 1140 may be made of molded plastic and may support the drawers 1126. The outer wall 1130 may be made of fabric and may be supported by a frame as illustrated in previous embodiments. The side tables 1120 and platform 1114 may be removable and may be stored in a table port 1136 or the like. The portable pantry 1124 may be removable and may include a fastener, such as a clamp or the like to attach the portable pantry to the side table 1120. Alternatively, the side table 1120 may include a rail 1142 to support the portable pantry 1124. The windscreen 1138 may comprise a light weight fabric supported by a flexible pole, similar to a tent pole.

The rack system 148 may include an additional vertical support 1150, telescoping rack poles 1152, and attachable storage receptacles 1154. The additional vertical support 1150 may telescopically extend from the vertical support member 1112 and may be locked into place with a locking mechanism (not shown). The handle 1116 may include telescoping rack poles 1152. Alternatively, the handle 1116 may include an attachment mechanism to attach a telescoping rack pole 1152.

The extended rack poles 1152 may create a greater surface area for hanging items such as a lamp 1156, a basket 1158, cooking utensils 1160, or the like. The attachable storage receptacles 1154 provide greater surface area for resting items during use. In certain embodiments, telescoping rack poles 1152 may be integrated with the attachable storage receptacles 154. An attachment device 1162 may be used to attach the telescoping rack poles 1152 and the storage receptacles 1154. In certain embodiments, the storage receptacles 1154 may attach to the telescoping rack poles 1152.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A lightweight, compact, portable workstation, the workstation comprising:

a base unit, the base unit comprising at least one vertical support member and a platform, the platform extending horizontally from the vertical support member, the platform forming a top to the base unit with the base unit positioned in an upright position, the platform comprising a work surface;

a handle coupled to the base unit, the handle facilitating transportation of the workstation;

at least one wheel attached to a bottom of the base unit, the at least one wheel facilitating transportation of the workstation;

a rear table configured to extend from a back side and near a top of the base unit, the rear table comprising a support leg, wherein the rear table is configured to alternate between an extended position and a storage position, the rear table providing support to the base unit in the extended position to support the base unit in the upright position;

a rack assembly comprising at least one additional vertical support configured to alternate between an extended position and a storage position, wherein the at least one additional vertical support extends vertically from the top of the base unit and is configured to support a removable organizer in the extended position such that items may be stored at an elevated position above the work surface of the platform leaving the work surface of the platform available for performing a task;

a side table configured to extend from a position near the top of the base unit, with an axis of the side table positioned at an angle perpendicular to an axis of the rear table when the side table and the rear table are positioned in an extended position, wherein the side table is configured to alternate between an extended position and a storage position; and wherein the handle is coupled to at least one of a first extension and a second extension, the first extension and the second extension coupled to the at least one additional vertical support such that the handle is configured to extend with the at least one additional vertical support, wherein at least one of the first extension and the second extension are configured to rotate from an inward position to an outward position, wherein the first extension and the second extension are coupled by the handle and operate as a handle in the inward position and provide an elevated support for attaching accessories at an elevated position above the support base when rotated to the outward position.

2. The workstation of claim 1, further comprising a removable organizer removably coupled to the at least one additional vertical support, the removable organizer providing an elevated storage area when the at least one additional vertical support is positioned in the extended position.

3. The workstation of claim 1, further comprising at least one storage compartment disposed along the vertical support member, wherein the base unit further comprises a wall configured to shelter the at least one storage compartment.

4. The workstation of claim 3, wherein the storage compartment comprises at least one of a shelf and a drawer.

5. The apparatus of claim 1, wherein the platform comprises a plurality of sections.

6. The workstation of claim 1, wherein the side table comprises an opening for a sink, wherein the sink comprises a receptacle for retaining liquid.

7. The workstation of claim 6, wherein the receptacle is collapsible.

8. The apparatus of claim 1, wherein the side table comprises a plurality of slats.

9. The apparatus of claim 8, wherein the slats are hingedly connected.

10. The workstation of claim 1, further comprising a removable organizer and wherein the rack assembly further comprises a second additional vertical support disposed parallel the at least one additional vertical support, wherein the removable organizer is removably attached to the at least one additional vertical support and the second additional vertical support such that the removable organizer spans a distance between the at least one additional vertical support and the second additional vertical support.

11. The workstation of claim 1, wherein the rack assembly further comprises a second additional vertical support disposed parallel to the at least one additional vertical support, the first extension coupled to the at least one additional support and the second extension coupled to the second additional support such that the first extension and the second extension span a distance between the first additional support and the second additional support with the first additional support and the second additional support positioned in the inward position, wherein the handle couples the first extension to the second extension with the first extension and the second extension positioned in the inward position.

12. A lightweight, compact, portable workstation, the workstation comprising:

a base unit, the base unit comprising at least one vertical support member and a platform, the platform extending horizontally from the at least one vertical support member, the platform forming a top to the base unit with the base unit positioned in an upright position, the platform comprising a work surface;

at least one storage compartment disposed along the at least one vertical support member;

at least one wheel attached to a bottom of the base unit, the at least one wheel facilitating transportation of the workstation;

a rear table configured to extend from a back side near a top of the base unit, the rear table comprising a support leg, wherein the rear table is configured to alternate between an extended position and a storage position, the rear table providing support to the base unit in the extended position to support the base unit in the upright position;

a side table configured to extend from a position near the top of the base unit, with an axis of the side table positioned at an angle perpendicular to an axis of the rear table when the side table and the rear table are positioned in an extended position, wherein the side table is configured to alternate between an extended position and a storage position;

a rack assembly comprising at least one additional vertical support configured to alternate between an extended position and a storage position, wherein the at least one additional vertical support extends vertically from the top of the base unit and is configured to support a removable organizer in the extended position such that items may be stored at an elevated position above the work surface of the platform leaving the work surface of the platform available for performing a task; and a handle coupled to at least one of a first extension and a second extension, the first extension and the second extension coupled to the at least one additional support such that the handle is configured to extend with the at least one additional vertical support, wherein at least one of the first extension and the second extension are configured to rotate from an inward position to an outward position, wherein the first extension and the second extension are coupled by the handle and operate as a handle in the inward position and provide an elevated support for attaching accessories at an elevated height above the support base when rotated in the outward position.

13. The workstation of claim 12, wherein the base unit further comprises a wall configured to shelter the at least one storage compartment, and wherein the wall comprises at least one of a flexible nylon material and a plastic material.

14. The workstation of claim 12, wherein the side table further comprises an opening for a collapsible sink.

15. The apparatus of claim 12, further comprising a strap connected to the base unit, the strap configured to facilitate transporting the base unit.

16. A lightweight, compact, portable workstation, the workstation comprising:

a base unit, the base unit comprising at least one vertical support member and a platform, the at least one vertical support member comprising a frame structure, the platform extending horizontally from the at least one vertical support member, the platform forming a top to the base unit with the base unit positioned in an upright position, the platform comprising a work surface;

at least one wheel attached to a bottom of the base unit, the at least one wheel facilitating transportation of the workstation;

at least one storage compartment disposed along the at least one vertical support member, the at least one storage compartment comprising a shelf;

a rear table configured to extend from a back side near a top of the base unit, the rear table comprising a support leg, wherein the rear table is configured to alternate between an extended position and a storage position, the rear table providing support to the base unit in the extended position to support the base unit in the upright position;

a rack assembly comprising a first additional vertical support disposed parallel a second additional vertical support, the first additional vertical support and the second additional vertical support configured to extend vertically from the top of the base unit in an extended position and to support a removable organizer in the extended position such that items may be stored at an elevated position above the work surface of the platform leaving the work surface of the platform available for performing a task;

a first extension coupled to the first additional vertical support and a second extension coupled to the second additional vertical support, wherein the first extension and the second extension are configured to rotate from an inward position to an outward position, wherein the first extension and the second extension span a distance between the first additional support and the second additional support in the inward position, the first extension and the second extension providing an elevated support for attaching accessories at an elevated height above the support base when rotated in the outward position;

a handle configured to coupled the first extension to the second extension when the first extension and the second extension are positioned in the inward position, the handle facilitating transportation of the workstation;

a side table configured to extend from a position near the top of the base unit, with an axis of the side table positioned at an angle perpendicular to an axis of the rear table when the side table and the rear table are positioned in an extended position, wherein the side table is configured to alternate between an extended position and a storage position, the side table comprising an opening for a sink, wherein the sink comprises a receptacle for retaining liquid; and a removable organizer removably coupled to the at least one additional vertical support, the removable organizer providing an elevated storage area when the at least one additional vertical support is positioned in the extended position.

17. The apparatus of claim 16, wherein the table comprises a plurality of slats hingedly connected and configured to fold for storage.

18. The apparatus of claim 16, further comprising a connecting member for connecting a plurality of vertical support members, wherein the connecting member comprises a fabric panel.

* * * * *

UNITED STATES PATENT AND TRADEMARK OFFICE

CERTIFICATE OF CORRECTION

PATENT NO. : 7,901,018 B2
APPLICATION NO. : 11/248825
DATED : March 8, 2011
INVENTOR(S) : Joe D. Baughman It is certified that error appears in the above-identified patent and that said Letters Patent is hereby corrected as shown below:

Column 1, Line 41
"These camp kitchen,"---should read "These camp kitchens,"

Column 5, Line 23
"may be made other"---should read "may be made of other"

Column 5, Line 60
"provide amble work"---should read "provide ample work"

Column 6, Line 1
"place on the platform"---should read "placed on the platform"

Column 6, Line 27
"maybe organized"---should read "may be organized"

Column 6, Line 67
"maybe used to secure"---should read "may be used to secure"

Column 8, Line 7
"maybe connected"---should read "may be connected"

Column 8, Line 44
"maybe removable"---should read "may be removable"

Column 8, Line 66
"maybe rotated"---should read "may be rotated"

Column 9, Line 2
"maybe removed"---should read "may be removed"

Signed and Sealed this
Tenth Day of May, 2011

David J. Kappos

David J. Kappos
*Director of the United States Patent and Trademark Office*

Column 10, Line 37
"storage receptacles 454 is suspended"---should read "storage receptacles 454 are suspended"

Column 11, Line 28
"the comers of the frame"---should read "the corners of the frame"

Column 11, Line 66-67
"maybe connected"---should read "may be connected"

Column 13, Line 64
"maybe configured"---should read "may be configured"

Column 14, Line 23
"maybe internal"---should read "may be internal"

Column 15, Line 31
"maybe installed"---should read "may be installed"

Column 15, Line 34-35
"maybe made of"---should read "may be made of"

Column 15, Line 38
"maybe attached"---should read "may be attached"

Column 15, Line 39
"maybe stored"---should read "may be stored"

Column 20, Line 34
"a handle configured to coupled"---should read "a handle configured to couple"